US007089910B2

(12) United States Patent
Kanno et al.

(10) Patent No.: US 7,089,910 B2
(45) Date of Patent: Aug. 15, 2006

(54) WATERCRAFT PROPULSION SYSTEM AND CONTROL METHOD OF THE SYSTEM

(75) Inventors: Isao Kanno, Hamamatsu (JP); Masahiko Kato, Hamamatsu (JP); Goichi Katayama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 24 days.

(21) Appl. No.: 10/619,333

(22) Filed: Jul. 14, 2003

(65) Prior Publication Data

US 2004/0069271 A1 Apr. 15, 2004

(30) Foreign Application Priority Data

Jul. 12, 2002 (JP) ..... 2002-204472

(51) Int. Cl.
*F02D 1/00* (2006.01)

(52) U.S. Cl. ..... 123/396; 123/308; 123/432

(58) Field of Classification Search ..... 123/308, 123/432, 396, 395
See application file for complete search history.

(56) References Cited

U.S. PATENT DOCUMENTS 4,445,473 A * 5/1984 Matsumoto ..... 123/308
5,144,300 A 9/1992 Kanno
5,184,589 A 2/1993 Nonaka
5,199,261 A * 4/1993 Baker ..... 60/612
5,352,138 A 10/1994 Kanno
5,665,025 A 9/1997 Katoh
5,687,694 A 11/1997 Kanno
5,904,604 A 5/1999 Suzuki et al.
6,032,653 A 3/2000 Anamoto
6,135,095 A 10/2000 Motose et al.
6,148,777 A 11/2000 Motose et al.
6,273,771 B1 8/2001 Buckley et al.
2002/0157639 A1* 10/2002 Kidokoro et al. ..... 123/396
2003/0221668 A1* 12/2003 Hashimoto et al. ..... 123/396

* cited by examiner

*Primary Examiner*—John T. Kwon
(74) *Attorney, Agent, or Firm*—Knobbe, Martens, Olson & Bear, LLP

(57) ABSTRACT

A propulsion system for a watercraft includes an engine. An air intake device delivers air to a combustion chamber. A throttle valve regulates an amount of the air. A control device sets the throttle valve to a desired position. A remote controller provides the control device with the desired position. The engine can include an auxiliary intake device that delivers supplemental air to the combustion chamber. A control valve normally shuts the supplemental air from the combustion chamber. The control device determines whether an abnormal condition occurs in setting the throttle valve to the desired position. The control device determines whether the amount of the air is insufficient. The control device controls the control valve to allow the supplemental air to move to the combustion chamber when the control device determines that the abnormal condition occurs and the amount of the air is insufficient.

13 Claims, 21 Drawing Sheets

338

LARGER

ENGINE SPEED Ne

| | | | |
|---|---|---|---|
| A11 | . . . | . . . | Am1 |
| A12 | | | ⋮ |
| ⋮ | | | ⋮ |
| ⋮ | | | ⋮ |
| ⋮ | | | ⋮ |
| A1n | . . . | . . . | Amn |

LARGER

ACTUAL THROTTLE VALVE POSITION $\theta_T$

FUEL INJECTION AMOUNT CALCULATION MAP

*Figure 7*

IGNITION TIMING
CALCULATION MAP

FUEL INJECTION AMOUNT ADJUSTMENT COEFFICIENT CALCULATION MAP

IGNITION TIMING ADJUSTMENT COEFFICIENT CALCULATION MAP

WATERCRAFT PROPULSION SYSTEM AND CONTROL METHOD OF THE SYSTEM

PRIORITY INFORMATION

This application is based on and claims priority under 35 U.S.C. §119 to Japanese Patent Application No. 2002-204472, filed on Jul. 12, 2002, the entire contents of which are hereby expressly incorporated by reference herein.

BACKGROUND OF THE INVENTION

1. Field of the Invention

The present application generally relates to a watercraft propulsion system and a control method of the system. The present application more particularly relates to a watercraft propulsion system that has an engine and a control method to control at least an operation of the engine.

2. Description of Related Art

Relatively small size watercraft can be powered by one or more outboard motors. The outboard motor normally has a propulsion device such as, for example, a propeller and an engine to power the propulsion device. The outboard motor can incorporate an air intake device that delivers air to the engine. The intake device can be provided with a throttle valve to regulate an amount of the air. The throttle valve moves between a closed position and an open position of the intake device. Normally, when the degree to which the throttle valve is opened increases, the air amount increases and the engine speed of the engine increases.

The engine, the propulsion device and the intake device, which incorporates the throttle valve, together are parts of a propulsion system of the watercraft. The propulsion system can include a control device that controls the opening degree or a position of the throttle valve. In some arrangements, the propulsion system can further include an operating unit such as, for example, a remote controller that is operated by the operator to provide a desired position of the throttle valve to the control device. Also, the propulsion system can include a valve actuator that is coupled with the throttle valve. The control device controls the valve actuator to move the throttle valve to the desired position provided by the operating unit.

The propulsion device normally is selectively operable in either forward, reverse or neutral mode. The propulsion device propels the watercraft forwardly when operating in the forward mode and propels the watercraft backwardly when operating in the reverse mode. The propulsion device does not propel the watercraft when operating in the neutral mode.

The outboard motor incorporates a changeover mechanism to change the propulsion device among the forward, reverse and neutral modes. The changeover mechanism generally is formed with a transmission that has forward and reverse bevel gears, a clutch device and a shift actuator. The shift actuator shifts the clutch device to engage the forward or reverse bevel gear such that the propulsion device operates in either the forward, reverse, or neutral mode. The operating unit can be used to provide the control device with the forward, reverse, or neutral mode of the propulsion device. In other words, the propulsion device can be set in the desired mode by the control device and the operating unit.

The control device can be connected to the valve actuator, the shift actuator and operating unit through a network and communicate with them through the network. The network is, for example, a controller area network (CAN); a particular type of local area network (LAN).

The watercraft propulsion system described above is conventional. For example, the U.S. Pat. No. 6,273,771 discloses such a propulsion system.

SUMMARY OF THE INVENTION

Under some conditions, a throttle valve of an internal combustion engine can gradually become inoperable. For instance, the throttle valve can initially begin to stick or move more slowly than desired due to an increase in frictional resistance, and eventually seize. Also, valve actuators can also malfunction and as a result, the throttle valve does not move to a valve position that the operator desires. In either event, the air flow into the engine can become unsatisfactory. Such a failure is particularly undesirable where the throttle valve is stuck in a closed or nearly closed position, that may allow the engine to stall.

In the event of an engine failure, land vehicles should be constructed so that the operator can stop safely. Thus, an emergency brake and some ability to at least temporarily steer can be sufficient for an automobile. After such an emergency stop, the operator of a land vehicle is likely to be able to find help without great difficulty. However, bodies of water can be quite vast. Thus, it is more desirable for a water vehicle to be configured to be operable even after a major engine failure, such as a throttle valve-related failure.

A need therefore exist for an improved watercraft propulsion system and control method thereof that can supply at least the minimum amount of air that can maintain the engine operation when an abnormal state occurs in setting the throttle valve to the desired position. For example, the engine can be configured to provide a supplemental amount of air when a throttle valve failure is detected.

The engine may not always need such supplemental air under the abnormal condition. In other words, the engine can be configured to use supplemental air when the throttle valve stays at the closed position or nearly at the closed position or when the throttle valve cannot completely follow the movement of the control device.

Normally, during operation of an outboard motor, an operator shifts the propulsion device to a proper operating mode, for example, a reverse operating position when the watercraft is berthing. The shift preferably is made under a low engine speed because the shifting mechanism cab be difficult to move when the engine speed is high. If an abnormal state, such as a throttle valve failure, keeps the engine speed high, it may not be possible to shift the gears of the propulsion device. Thus, a further need exists for an improved watercraft propulsion system and control method thereof that can slow down an engine speed during shifting, such as when an operator of the watercraft is docking.

An engine control system can be configured with a control device that receives a desired throttle valve position from the operating unit over a network. If an abnormal state occurs at the operating unit or the network, the control device cannot receive the desired valve position and the propulsion system will not work in accordance with the operator's commands.

Thus, an improved watercraft propulsion system and control method thereof can be configured to provide a backup that recovers a proper operation of the propulsion system that has failed.

In accordance with one aspect of at least one of the inventions disclosed herein, a propulsion system for a watercraft comprises an internal combustion engine that defines a combustion chamber. An intake device delivers air to the combustion chamber. A throttle valve regulates an amount of the air. A control device sets the throttle valve to a desired position. An operating unit provides the control device with the desired position. Means are provided for delivering at least a minimum amount of air that maintains an operation of the engine to the combustion chamber when an abnormal condition occurs in setting the throttle valve to the desired position.

In accordance with another aspect of at least one of the inventions disclosed herein, a propulsion system for a watercraft comprises an internal combustion engine that defines a combustion chamber. A first intake device delivers first air to the combustion chamber. A first valve regulates an amount of the first air. A control device sets the first valve to a desired position. An operating unit provides the control device with the desired position. A second intake device delivers second air to the combustion chamber. A second valve normally shuts the second air from the combustion chamber. The control device determines whether an abnormal condition occurs in setting the first valve to the desired position. The control device determines whether the amount of the first air is insufficient. The control device controls the second valve to allow the second air to move to the combustion chamber when the control device determines that the abnormal condition occurs and the amount of the first air is insufficient.

In accordance with a further aspect of at least one of the inventions disclosed herein, a propulsion system for a watercraft comprises an internal combustion engine that defines a combustion chamber. An intake device delivers air to the combustion chamber. A throttle valve regulates an amount of the air. A control device sets the throttle valve to a desired position. An operating unit provides the control device with the desired position. The control device determines whether an abnormal state occurs in setting the throttle valve to the desired position. The control device determines whether the watercraft is berthing. The control device decreases an engine speed of the engine when the control device determines that the abnormal state occurs and the watercraft is berthing.

In accordance with a further aspect of at least one of the inventions disclosed herein, a propulsion system for a watercraft comprises an outboard drive. The outboard drive has a propulsion device that propels the watercraft. The propulsion device is selectively operable at least in a forward or reverse mode. An internal combustion engine powers the propulsion device. The engine defines a combustion chamber. An intake device delivers air to the combustion chamber. A throttle valve regulates an amount of the air. A control device sets the propulsion device in the forward or reverse position and sets the throttle valve to a desired position. An operating unit provides the control device with the forward or reverse mode and the desired position. The control device determines whether an abnormal state occurs in setting the throttle valve to the desired position. The control device determines whether the operating unit provides the control device with the reverse mode. The control device decreases an engine speed of the engine when the control device determines that the abnormal state occurs and that the operating unit provides the control device with the reverse mode.

In accordance with a further aspect of at least one of the inventions disclosed herein, a propulsion system for a watercraft comprises an outboard drive. The outboard drive has a propulsion device that propels the watercraft. The propulsion device is selectively operable at least in a forward or reverse mode. An internal combustion engine powers the propulsion device. The engine defines a combustion chamber. An intake device delivers air to the combustion chamber. A throttle valve regulates an amount of the air. A throttle valve is capable to be set to a desired position. An operating unit operates the propulsion device between the forward and reverse modes. A connecting device selectively connects the throttle valve and the operating device. A control device determines whether an abnormal state occurs in setting the throttle valve to the desired position. The control device activates the connecting device to connect the throttle valve and the operating unit when the control device determines that the abnormal state occurs.

In accordance with a further aspect of at least one of the inventions disclosed herein, a propulsion system for a watercraft comprises an internal combustion engine that defines a combustion chamber. An intake device delivers air to the combustion chamber. A throttle valve regulates an amount of the air. A control device sets the throttle valve to a desired position. An operating unit provides the control device with the desired position. The operating unit communicates with the control device through a communication device. An auxiliary operating unit is capable to replace the operating unit when an abnormal state occurs at the operating unit or in the communication device.

In accordance with a further aspect of at least one of the inventions disclosed herein, a propulsion system for a watercraft comprises an internal combustion engine that defines a combustion chamber. An intake device delivers air to the combustion chamber. A throttle valve regulates an amount of the air. A control device sets the throttle valve to a desired position. An operating unit provides the control device with the desired position. The operating unit communicates with the control device through a communication device. An alarming device alarms when an abnormal state occurs in the communication device.

In accordance with a further aspect of at least one of the inventions disclosed herein, a control method is provided for controlling a watercraft propulsion system that has an engine. The control method comprises regulating an amount of air to the engine by a regulating device, setting the regulating device to a desired regulating position, providing the desired regulating position by an operating unit, determining whether an abnormal state occurs in setting the regulating device to the desired regulating position, and delivering at least a minimum amount of air to the engine so as to maintain an operation of the engine when the occurrence of the abnormal state is determined.

In accordance with a further aspect of at least one of the inventions disclosed herein, a control method is proved for controlling a watercraft propulsion system that has an engine. The control method comprises regulating an amount of air to the engine by a regulating valve, setting the regulating valve to a desired regulating position, providing the desired regulating position by an operating unit, determining whether an abnormal state occurs in setting the regulating valve to the desired regulating position, determining whether the watercraft is berthing, and decreasing an engine speed of the engine when the occurrence of the abnormal state is determined and the berthing condition of the watercraft is determined.

In accordance with a further aspect of at least one of the inventions disclosed herein, a control method is provided for controlling a watercraft propulsion system that has an engine and a propulsion device. The control method comprises regulating an amount of air to the engine by a regulating valve, setting the regulating valve to a desired regulating position, providing the desired regulating position by an operating unit, providing a forward or reverse mode of the propulsion device by the operating unit, determining whether an abnormal state occurs in setting the regulating valve to the desired regulating position, determining whether the reverse mode is provided by the operating unit, and decreasing an engine speed of the engine when the occurrence of the abnormal state is determined and the provision of the reverse mode by the operating unit is determined.

In accordance with a further aspect of at least one of the inventions disclosed herein, a control method is provided for controlling a watercraft propulsion system that has an engine. The control method comprises regulating an amount of air to the engine by a regulating device, setting the regulating device to a desired regulating position, providing the desired regulating position by an operating unit, determining whether the desired regulating position is normally provided to the regulating device by the operating unit, and alarming when the determination is negative.

BRIEF DESCRIPTION OF THE DRAWINGS

These and other features, aspects and advantages of the present inventions are described below with reference to the drawings of preferred embodiments, which are intended to illustrate and not to limit the inventions. The drawings comprise 21 figures in which:

FIG. 7 is a fuel injection amount calculation map that can be used in conjunction with the flow chart of FIG. 6;

DETAILED DESCRIPTION OF THE PREFERRED EMBODIMENTS

First Embodiment

Figure 1:
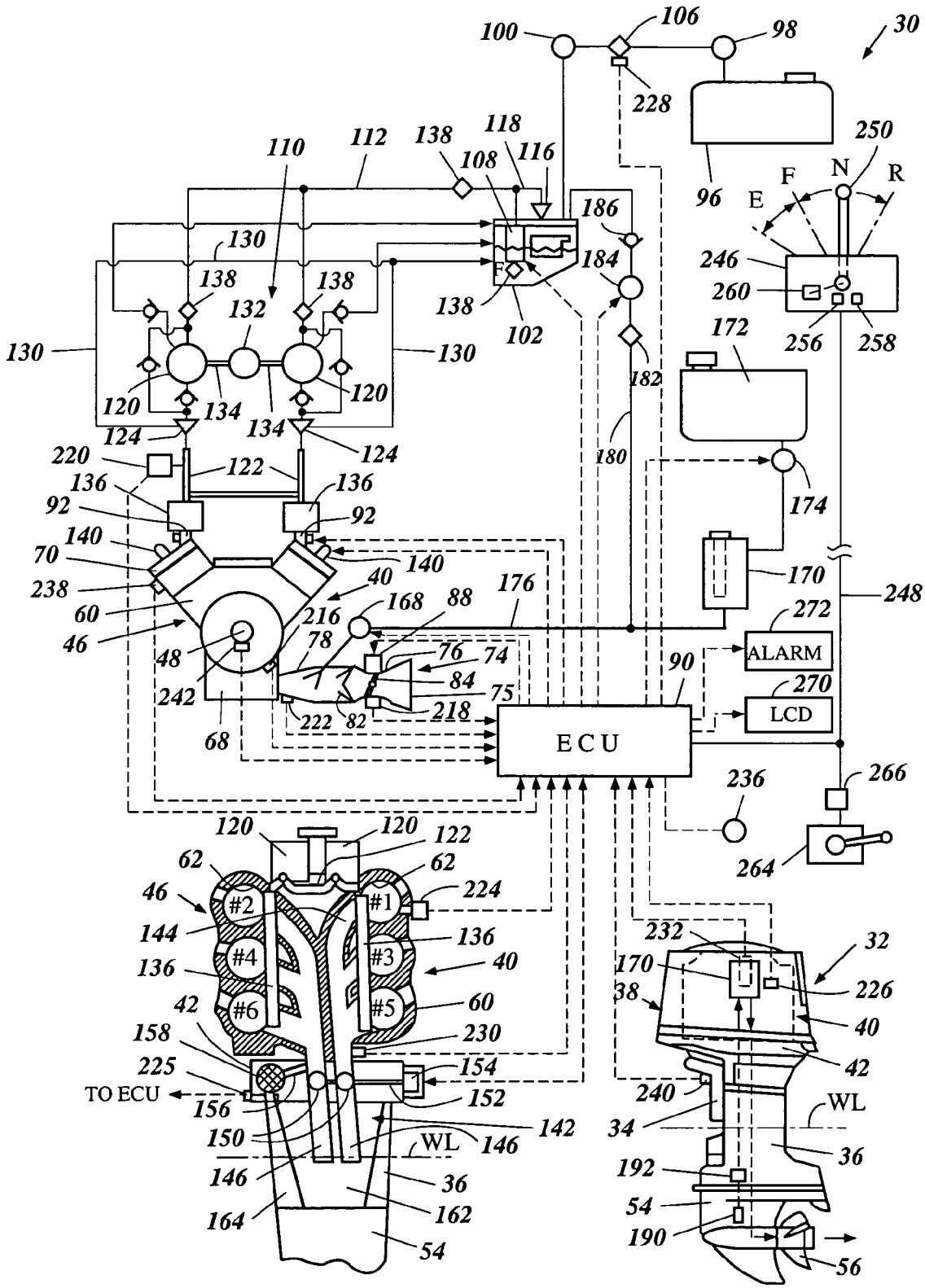
FIG. 1 illustrates a schematic multi-part view showing a watercraft propulsion system configured in accordance with a first embodiment: in the lower right-hand portion, a side elevational view of an outboard motor that is a part of the watercraft propulsion system; in the upper portion, a partially schematic cross-sectional view of an engine of the outboard motor, an air induction system, a fuel injection system and a lubrication system shown in part schematically; in the lower left-hand portion, a rear elevational view of the outboard motor with portions removed and other portions broken away and shown in cross section so as to more clearly illustrate the construction of the engine, with the fuel injection system shown schematically in part: and in the most right-hand portion next to the upper portion, a remote controller and an auxiliary controller, wherein an electronic control unit (ECU) for the watercraft propulsion system links all the views together.

With reference to FIG. 1, a watercraft propulsion system 30 configured in accordance with features, aspects, and advantages of at least one of the present inventions disclosed herein, and particularly a first embodiment thereof is described below. The illustrated watercraft propulsion system 30 has particular utility if the propulsion system incorporates an outboard motor, and thus is described in the context of a propulsion system that has an outboard motor. The watercraft propulsion system, however, can incorporate other types of marine drives such as, for example, stern drives and jet drives, which is become apparent to those of ordinary skill in the art in light of the disclosure set forth herein.

With particular reference to the lower-right hand view of FIG. 1, an outboard motor 32 is depicted from the side. The outboard motor 32 has a bracket assembly 34 comprising a swivel bracket and a clamping bracket which are typically associated with a driveshaft housing 36. The outboard motor 32 is detachably mounted on a transom of an associated watercraft 37 (FIG. 2) by the bracket assembly 34.

The outboard motor 32 includes a power head 38 that is positioned above the driveshaft housing 36. The power head 38 comprises a protective cowling assembly and an internal combustion engine 40. This engine 40 is illustrated in greater detail in the remaining two views of this figure, and is described below with reference thereto.

The protective cowling assembly includes a top cowling member and a bottom cowling member. Both the top and bottom cowling members together define a closed cavity in which the engine 40 is housed. The top cowling member is detachably affixed to the bottom cowling member such that the user or service person can access the engine 40 for maintenance service or for other purposes. The top cowling member preferably defines air intake openings on a rear and upper end surface. Air thus can be drawn into the cavity.

An engine support or exhaust guide 42 is unitarily or separately formed atop the driveshaft housing 36 and forms a tray together with the bottom cowling member. The tray can hold a bottom of the engine 40 and the engine 40 is affixed to the engine support 42.

The engine 40 comprises an engine body 46 (the upper and the lower-left hand views of FIG. 1) and a crankshaft 48 (the upper view of FIG. 1) that is rotatably journaled on the engine body 46. The crankshaft 48 rotates about a generally vertically extending axis. This facilitates the connection of the crankshaft 48 to a driveshaft 50 (FIG. 2) which depends into the driveshaft housing 36.

A lower unit 54 depends from the driveshaft housing 36. A propulsion device is mounted on the lower unit 54 and the driveshaft 50 drives the propulsion device. The propulsion device in this embodiment is a propeller 56. The driveshaft 50 drives the propeller 56 through a transmission disposed within the lower unit 54. The transmission in this embodiment is part of a changeover mechanism 58 (FIG. 2) that can change a rotational direction of the propeller 56 among forward, neutral and reverse. The changeover mechanism 58 will be described in greater detail with reference to FIG. 2. The propulsion device can take the form of a dual counter-rotating system, a hydrodynamic jet, or any of a number of other suitable propulsion devices.

With particular reference to the upper view and the lower left-hand view of FIG. 1, the engine 40 preferably operates on a two-stroke, crankcase compression principle. The engine body 46 has a cylinder block 60 that is generally configured as V-shape to form a pair of cylinder banks that extend generally rearward. Each bank defines three cylinder bores 62. The cylinder bores 62 are numbered #1–#6 in the lower left-hand view. The cylinder bores 62 extend generally horizontally and are vertically spaced apart from each other in each bank. Although the propulsion system 30 is described in conjunction with the engine 40, the propulsion system 30 can be utilized with an engine that has other numbers of cylinder and other cylinder configurations.

Pistons (not shown) are reciprocally disposed within the cylinder bores 62. The crankshaft 48 is journaled for rotation within a crankcase chamber defined in part by a crankcase member 68 that is affixed to the cylinder block 60 in a suitable manner. The pistons are coupled with the crankshaft 48 through connecting rods. The crankshaft 48 thus rotates with the reciprocal movement of the pistons.

Cylinder head assemblies 70 are affixed to each cylinder bank to close open ends of the respective cylinder bores 62. Each cylinder head assembly 70 comprises a cylinder head member that defines a plurality of recesses on its inner surface corresponding to the cylinder bores 62. Each of these recesses defines a combustion chamber together with the cylinder bore 62 and the piston. Cylinder head cover members complete the cylinder head assemblies 70. The cylinder head members and cylinder head cover members are affixed to each other and to the respective cylinder banks.

The engine 40 preferably is provided with a primary air intake device 74 that delivers air to the combustion chambers through sections of the crankcase chamber associated with the cylinder bores 62. The primary intake device 74 comprises an air inlet device 75, a throttle body 76 and an air intake conduit 78. The air inlet device 75 defines a plenum chamber through which the air is drawn into the intake device 74. The throttle body 76 is coupled with a downstream portion of the inlet device 75. The air intake conduit 78 is coupled with a downstream portion of the throttle body 76. The throttle body 76 and the intake conduit 78 define six air passages that connect the plenum chamber and each section of the crankcase chamber associated with each combustion chamber. The air drawn into the plenum chamber thus is delivered to the sections of the crankcase chamber through the intake passages. The plenum chamber defined by the air inlet device 75 smoothes the air and reduces intake noise.

Each portion of the air passage defined within the intake conduit 78 preferably incorporates a reed valve 82 that allows the air to flow one section of the crankcase chamber and prevents the air in the section of the crankcase chamber from flowing back to the plenum chamber.

Each portion of the air passage defined within the throttle body 76 preferably incorporates a throttle valve 84. The illustrated throttle valve 84 is a butterfly type and is pivotally journaled on the throttle body 76 to regulate an amount of the air. That is, the air amount moving through the throttle body 76 varies in accordance with an angular position or an opening degree of each throttle valve 84. The operator can change the angular position of the throttle valves 84 (i.e., throttle valve position) through an operating mechanism.

The operating mechanism preferably comprises a throttle valve actuator that is controlled by a control device. The throttle valve actuator preferably is a servo motor 88 that is coupled with the throttle valves 84 in a manner that is described below. The servo motor 88 can rotate both directions. The control device preferably is an electronic control unit (ECU) 90. The ECU 90 commands the servo motor 88 to actuate the throttle valves 84 to a certain angular position between a closed position and an open position. The closed position is a position at which each intake passage defined within the throttle body 76 is closed, while the open position is a position at which each intake passage defined within the throttle body 76 is opened. The operator's demand, which designates a desired position of the throttle valves 84, is provided to the ECU 90 by an operating unit that is described below.

In general, the ECU 90 comprises at least a central processing unit (CPU) or microprocessor and a storage device or memory. The memory stores various control programs and control maps or references. The CPU is a major control part of the ECU 90 and conducts the control programs or "routines" with reference to the control maps based upon signals from sensors and commands components in the watercraft propulsion system 30 such as, for example, the servo motor 88. The ECU 90, the control programs, the control maps, the sensors and the actuators are described in greater details below.

The air drawn into the respective sections of the crankcase chamber is preliminary compressed as the pistons move toward the crankcase. The air, then, moves into the combustion chambers through a scavenge system. The scavenge system preferably is formed as a Schnurle type system that comprises a pair of main scavenge passages connected to each cylinder bore 62 and positioned on diametrically opposite sides. These main scavenge passages terminate in main scavenge ports so as to direct scavenge air flows into the combustion chamber.

In addition, an auxiliary scavenging passage preferably is formed between the main scavenge passages and terminates in an auxiliary scavenging port which also provides a scavenge air flow. Thus, at the scavenge stroke, the air in the crankcase chamber is transferred to the combustion chambers to be further compressed by the pistons during a following compression stroke. The scavenge ports are selectively opened and closed as the piston reciprocates.

The engine 40 preferably is provided with a fuel supply system or device that delivers fuel to the combustion chambers. The illustrated fuel supply system applies a direct fuel injection method in which the fuel is directly sprayed into the combustion chambers.

The fuel supply system comprises fuel injectors 92, one allotted to each of the respective combustion chambers. The fuel injectors 92 preferably are mounted on the cylinder head assemblies 70. The ECU 90 preferably controls the fuel injectors 92. Preferably, the ECU 90 in this embodiment controls an injection timing and an amount of fuel injected by each fuel injectors 90. Under the circumstances such that the fuel pressure is kept in constant, as described below, the ECU 90 manages a duration of each injection to control the fuel injection amount.

The fuel supply system additionally comprises a fuel supply tank 96 that preferably is placed in a hull of the watercraft 37. A first low pressure fuel pump 98 and at least one second low pressure fuel pump 100 draw the fuel in the tank 96 into a vapor separator 102. The first low pressure pump 98 is a manually operated pump. The second low pressure pump 100 is a diaphragm type pump operated by pulsations that occur in the sections of the crankcase chamber. A quick disconnect coupling is provided in a conduit that connects the first low pressure pump 98 to the second low pressure pump 100 to detachably connect a portion of the conduit on the watercraft side with another portion of the conduit on the outboard motor side. A fuel filter 106 is positioned between the first low pressure pump 98 and the second lower pressure pumps 100. The fuel filter 106 removes foreign substances such as, for example, water in the fuel.

The illustrated vapor separator 102 comprises a fuel reservoir in which the fuel can be reserved. The vapor separator 102 has an inner construction that can separate vapor from the fuel to prevent the vapor lock from occurring in the fuel supply system. A pre-pressurizing fuel pump 108 preferably is disposed in the cavity of the vapor separator 102. The pre-pressurizing pump 108 in this embodiment is formed with an electric pump. The pre-pressurizing pump 108 pressurizes the fuel in the vapor separator 102 to a high pressure fuel pump unit 110 through a preload (or pre-pressure) fuel conduit 112 that defines a preload fuel passage. The pressure developed by the pre-pressurizing pump 108 is greater than the pressure developed by the second low pressure pump 100; however, the pressure developed by the pump 108 is less than a pressure developed by the high pressure pump unit 110. In other words, the pre-pressurizing pump 108 develops a pressure that reaches a certain level and the high pressure pump 110 raises the pressure at the certain level to a higher level.

A preload (or pre-pressure) regulator 116 is provided in a return passage 118 that connects the preload fuel conduit 112 with the vapor separator 102 to return excessive fuel to the vapor separator 102. The preload regulator 116 limits the pressure that is delivered to the high pressure fuel pump unit 110 by dumping the fuel back to the vapor separator 102.

The high pressure pump unit 110 preferably comprises a pair of high pressure fuel pumps 120. The illustrated preload conduit 112 is bifurcated into two sections that are connected to the high pressure pumps 120. High pressure fuel passages 122 extend from the respective pumps 120. Flexible conduits preferably define the fuel passages 122. High pressure regulators 124 are disposed in the respective fuel passages 122 to regulate the high pressure at a constant or fixed high pressure. Excessive fuel returns back to the vapor separator 102 through return passages 130.

The high pressure pump unit 110 preferably is disposed atop and in the rear of the cylinder block 60. Preferably, the illustrated pump unit 110 is generally positioned between both of the banks. The pump unit 110 is affixed to the cylinder block 60 so as to overhang between the two banks of the V arrangement. In the illustrated embodiment, the high pressure pump unit 110 additionally comprises a pump drive 132 that includes a cam disc. The high pressure fuel pumps 120 are disposed on both sides of the pump drive 132 and affixed thereto.

The pump drive 132 has a drive shaft. The cam disc is affixed onto the drive shaft and engages plungers 134 of the respective high pressure pumps 120. The high pressure fuel pumps 120 pressurize the fuel with the plungers 134 when the cam disc pushes the plungers 134 when the drive shaft rotates. A driven pulley preferably is affixed atop of the drive shaft. Also, a drive pulley is affixed atop of the crankshaft 48. An endless drive belt is wound around the driven and drive pulleys. The crankshaft 48 thus drives the drive shaft of the pump drive 132.

The high pressure fuel passages 122 are connected to respective fuel rails 136. The fuel rails 136 couple the fuel passages 122 with the respective fuel injectors 92. The fuel rails 136 are affixed to the respective cylinder head assemblies 70 so as to extend generally vertically. Preferably, the fuel injectors 92 are coupled to the fuel rails 136 with the respective internal fuel paths of the fuel injectors 92 that are connected with the internal passages of the fuel rails 136. Also, the fuel injectors 92 preferably are affixed to each cylinder head assembly 70 on their own.

The fuel supply system can comprise other components and members. For example, the illustrated fuel supply system incorporates fuel filters 138 other than the fuel filter 106.

With reference to the upper view of FIG. 1, the engine 40 preferably is provided with an ignition system or device. Spark plugs 140 are affixed to the cylinder head assemblies 70 so as to expose into the combustion chambers. The spark plugs 140 ignite air/fuel charges in the combustion chambers also under control of the ECU 90. Preferably, the ECU 90 controls an ignition timing of the spark plugs 140.

With reference to the lower left-hand view of FIG. 1, the engine 40 preferably is provided with an exhaust device 142 that routes burned charges, i.e., exhaust gases to an external location from the combustion chambers. The illustrated exhaust device 142 discharges the exhaust gases to the body of water surrounding the outboard motor 32 except for the exhaust gases at idle. Each cylinder bore 62 has an exhaust port 144 which is selectively opened or closed with the piston reciprocating.

A pair of exhaust manifolds 146 connects the exhaust ports 144 on the respective banks and guide the exhaust gases from the exhaust ports 144 into the driveshaft housing 36 through the exhaust guide 42. The exhaust manifolds 146 preferably extend vertically and parallel to each other within a valley defined by both of the banks. One exhaust manifold 146 communicates with the cylinder bores 62 having the odd numbers #1, #3, #5, while another exhaust manifold 146 communicates with the cylinder bores 62 having the even numbers #2, #4, #6.

Each exhaust manifold 146 in this embodiment has an exhaust valve 150, which preferably is a butterfly type. A common valve shaft 152 couples the respective exhaust valves 150 with each other such that the respective exhaust valves 150 are pivotally journaled within the respective exhaust passages defined by the exhaust manifolds 146. An exhaust valve actuator 154, which preferably is a servo motor, actuates the valve shaft 152 under control of the ECU 90. Preferably, the valve shaft 152 extends through the exhaust guide 42 and the exhaust valve actuator 154 is mounted on an outer surface of the exhaust guide 42.

In the illustrated embodiment, a branch conduit 156 is branched off at an upstream portion in each exhaust manifold 46. Each branch conduit 156 carries a catalyst 158 therein and has an outlet that opens downstream of the catalyst 158. FIG. 1 schematically illustrates one branch conduit 156 and one catalyst 158. The branch conduits 156 preferably extend within the exhaust guide 42.

The driveshaft housing 36 and the lower unit 54 define an exhaust gas discharge passage that is opened to an external location. Specifically, the driveshaft housing 36 in this embodiment defines an exhaust expansion chamber 162 that reduces exhaust noise. The exhaust manifolds 146 and the outlets of the branch conduits 156 preferably open to the expansion chamber 162. A water pool 164 preferably is formed around the expansion chamber 162 to inhibit the driveshaft housing 36 from excessively heated by the exhaust gases. The water in the water pool 164 is supplied by a water cooling system, which will be described below, and is discharged to the external location with the exhaust gases. In one variation, the outlets of the branch conduits 56 can open to the water pool 164.

The expansion chamber 162 communicates with a hub of the propeller 56. The hub of the propeller 56 defines an opening that is normally positioned under the waterline WL. The waterline WL illustrated in FIG. 1 is a waterline when the engine 40 operates at idle (i.e., almost the lowest engine speed). The waterline WL goes down to almost the bottom of the driveshaft housing 36 when the engine 40 operates above idle such as, for example, at a normal running speed; however, the propeller hub is still positioned sufficiently under the waterline. Thus, the exhaust gases are discharged to the body of water through the propeller hub all the time.

In the illustrated embodiment, the ECU 90 controls the exhaust valve actuator 154 in response to the valve position (i.e., opening degree) of the throttle valves 84. For instance, the ECU 90 commands the exhaust valve actuator 154 to keep the exhaust valves 150 at a closed position when the throttle valves 84 are placed in a range from the minimum opening degree for the idle operation to an opening degree that is approximately 1/10–1/8 of the full opening degree for a low speed operation. Under this condition, the entire exhaust gases pass through the catalysts 158. On the other hand, the ECU 90 commands the exhaust valve actuator 154 to gradually open the exhaust valves 150 in response to the opening degree of the throttle valves 84 when the throttle valves 84 are placed above the foregoing range. Thus, some of the exhaust gases pass through the catalysts 158, while the remainder of the exhaust gases pass through the exhaust valves 150. A threshold opening degree of the throttle valves 84 can be preset.

Optimum positions of the exhaust valves 150 corresponding to the opening degrees of the throttle valves 84 can be sought in previous experiments so as to improve exhaust conditions. For example, the exhaust valve control can properly manage residual amounts of exhaust gases within the cylinder bores 62 in an exhaust gas re-circulation system (EGR) or amounts of air/fuel charges that blow out from the combustion chambers before ignited.

In one variation, a mechanical link can replace the exhaust valve actuator 154. That is, the mechanical link can connect the valve shaft 152 of the exhaust valves 150, with a valve shaft or valve shafts of the throttle valves 84 such that the exhaust valves 150 mechanically move together with the throttle valves 84.

Each fuel injector 90 sprays fuel directly into the associated combustion chamber. The sprayed fuel is mixed with the air delivered through the scavenge passages to an air/fuel charge. The spark plug 140 fires the air/fuel charge. The injection timing and duration of the fuel injection and the firing timing are under control of the ECU 90. Once the air/fuel charge bums in the combustion chamber, each piston is moved by the extraordinary pressure produced in the combustion chamber. At this time, each exhaust port 144 is uncovered. The burnt charge or exhaust gases are discharged from the combustion chambers. The exhaust gases flow down toward the propeller hub either through the exhaust valves 150 or the catalysts 158 in response to the opening degree of the exhaust valves 150 and then go out to the body of water through the propeller hub.

With reference to the upper view of FIG. 1, the engine 40 is provided with a lubrication system or device. The lubrication system preferably comprises a lubrication pump 168. The lubrication pump 168 periodically pressurizes lubricant toward portions of the engine 40 that need lubrication. In the illustrated arrangement, the lubrication pump 168 has one inlet port and six outlet ports. The outlet ports are connected to the respective intake passages of the intake conduits 78 and positioned downstream of the reed valves 82. The lubricant is drawn into the crankcase chamber together with the air and is delivered to the engine portions such as, for example, connecting portions of the connecting rods with the pistons and also with the crankshaft 48.

A main lubricant tank 170 and a sub-tank 172 are arranged upstream of the lubrication pump 168. The main tank 170 preferably is mounted on either one of the cylinder banks, while the sub-tank 172 placed upstream of the main tank 170 and preferably in the hull of the associated watercraft. A lubricant supply pump 174 is disposed between the sub-tank 172 and the main tank 170 to supply the lubricant in the sub-tank 172 to the main tank 170 under control of the ECU 90. The lubricant is delivered to the inlet port of the lubrication pump 168 through a lubricant supply passage 176. The lubrication pump 168 injects the lubricant into each intake passage of the intake conduit 78 through each outlet port. The ECU 90 also controls the injection of the lubricant.

In the illustrated arrangement, some forms of direct lubrication can be additionally employed for delivering lubricant directly to certain engine portions. A lubricant delivery passage 180 preferably is branched off from the lubricant supply passage 176 to connect the lubrication system with the fuel supply system. A filter 182, a lubricant delivery pump 184 and a check valve 186 are disposed in the lubricant delivery passage 180. The filter 182 removes foreign substances from the lubricant. The delivery pump 176 pressurizes the lubricant to the vapor separator 102 under control of the ECU 90. The check valve 186 allows the lubricant to flow to the vapor separator 102 from the lubrication system and prevents the lubricant from flowing back to the lubrication system from the fuel supply system. Thus, a portion of the lubricant in the lubrication system is directly supplied to the engine portions that need lubrication.

The engine 40 and the exhaust device 142 can build much heat during the engine operations. With reference to the lower right-hand view of FIG. 1, the outboard motor 32 preferably is provided with a cooling system that cools the engine body 46 and the exhaust device 142. The cooling system preferably is an open-loop type that introduces cooling water from the body of water and discharges the water to the body of water. A water inlet 190 is defined at a side surface of the lower unit 54 submerged when the outboard motor 32 is under a normal operating condition. A water pump 192 pressurizes the water to the water jackets of the engine body 46 and the exhaust device 142. The water that has traveled around the engine body 46 and the exhaust device 142 is discharged to the body of water together with the exhaust gases through the hub of the propeller 56.

The engine 40 can be provided other systems, devices and components. For example, a flywheel magneto can be disposed atop the engine body 46 and be coupled with the crankshaft 48 to generate electric power with the crankshaft 48 rotating and also to balance the crankshaft 48. A starter motor also can be disposed on one side of the engine body 46 and be coupled with the crankshaft via some gears to start the engine operation.

Figure 2:
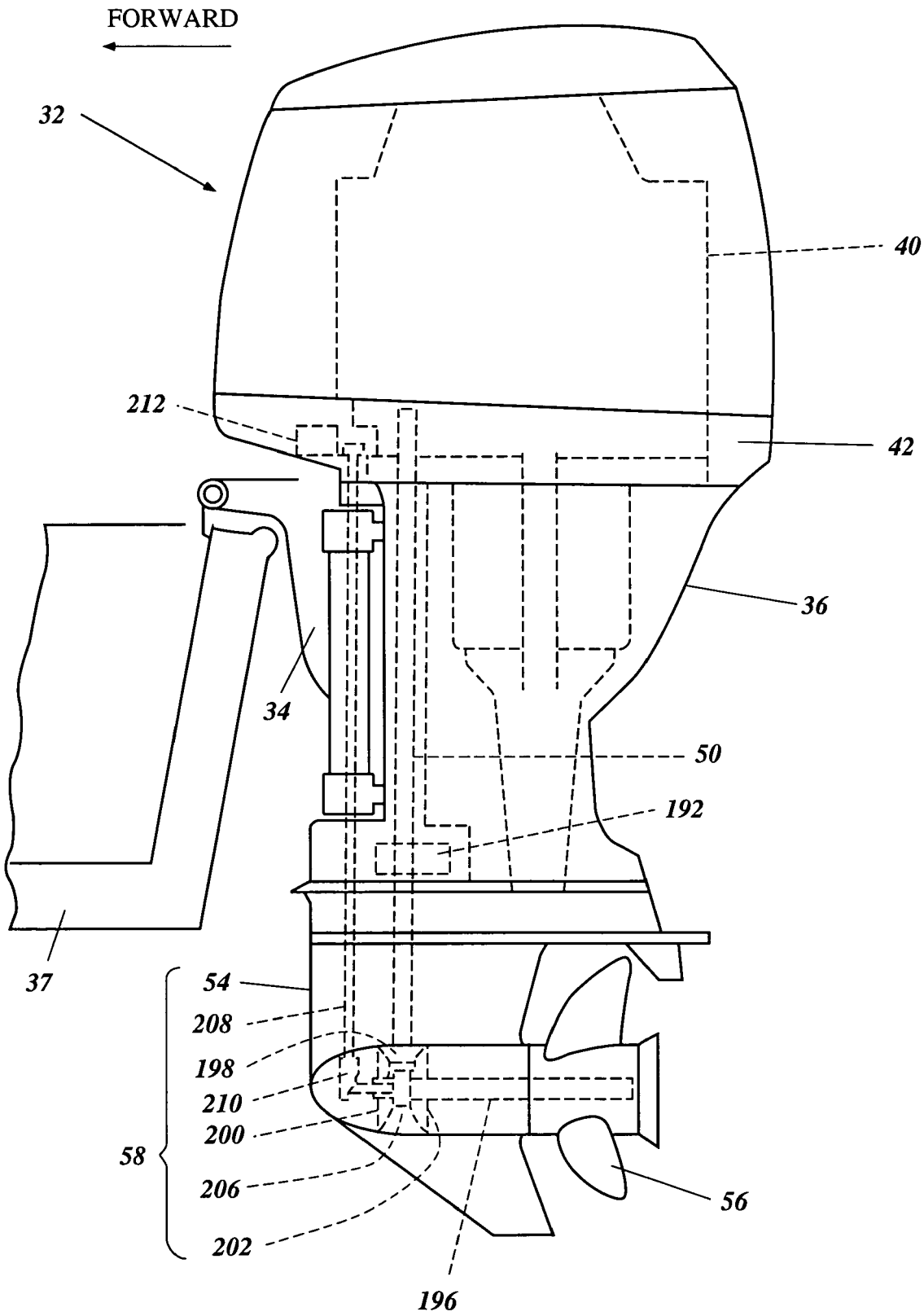
FIG. 2 is an enlarged side elevational view of the outboard motor mounted on a transom of an associated watercraft.

With reference to FIG. 2, the changeover mechanism 58 now is described in greater detail below.

The driveshaft 50 extends generally vertically through the driveshaft housing 36 and the lower unit 54. A propulsion shaft 196 extends generally horizontally through the lower unit 54 and is journaled for rotation in the lower unit 54. The propeller 56 is affixed to the outer end of the propulsion shaft 196. The driveshaft 50 and the propulsion shaft 196 are preferably oriented normal to each other (e.g., the rotation axis of propulsion shaft 196 is at 90° to the rotation axis of the driveshaft 50).

The changeover mechanism 58 preferably is provided between the driveshaft 50 and the propulsion shaft 196. The changeover mechanism 58 in this embodiment comprises a drive pinion 198, a forward bevel gear 200 and a reverse bevel gear 202 to couple the two shafts 50, 196. The drive pinion 198 is disposed at the bottom of the driveshaft 50. The forward and reverse bevel gears 202, 202 are disposed on the propulsion shaft 196 and spaced apart from each other. Both the bevel gears 200, 202 always mesh with the drive pinion 198. The bevel gears 200, 202, however, race on the propulsion shaft 196 unless those are fixedly coupled with the propulsion shaft 196.

A dog clutch unit 206, which also is a member of the changeover mechanism 58, is slidably but not rotatably disposed between the bevel gears 200, 202 on the propulsion shaft 196 so as to selectively engage the forward bevel gear 200 or the reverse bevel gear 202 or not engage any one of the forward and reverse bevel gears 200, 202. The forward bevel gear 200 or the reverse bevel gear 202, which engages the dog clutch unit 206, can be fixedly coupled with the propulsion shaft 196.

The changeover mechanism 58 further has a shift rod 208 that preferably extends vertically through the swivel bracket of the bracket assembly 34. The shift rod 208 can pivot about an axis of the shift rod 208. The shift rod 208 has a cam 210 at the bottom. The cam 210 abuts a front end of the dog clutch unit 206. The dog clutch unit 206 thus follows the pivotal movement of the cam 210 and slides on the propulsion shaft 196 to engage either the forward or reverse bevel gear 200, 202 or not engage any one of the bevel gears 200, 202. In other words, the dog clutch unit 206 moves among shift positions corresponding to the engagement states or non-engagement state.

In the illustrated embodiment, a shift rod actuator 212, which preferably is a servo motor, is coupled with the top end of the shift rod 208 to pivot the shift rod 208. The shift rod actuator 212 is under control of the ECU 90. The ECU 90 commands the shift rod actuator 212 to actuate the shift rod 208 toward cam positions corresponding to the shift positions. The operator can select one of the shift positions. The operator's selection is provided to the ECU 90 by the operating unit, which will be described below.

The shift positions correspond to operational modes of the propeller 56. The operational modes of the propeller 56 include a forward mode, a reverse mode and a neutral mode. The shift position in which the dog clutch unit 206 engages the forward bevel gear 200 corresponds to the forward mode. The shift position in which the dog clutch unit 206 engages the reverse bevel gear 202 corresponds to the reverse mode. The shift position in which the dog clutch unit 206 does not engage the forward bevel gear 200 or the reverse bevel gear 202 corresponds to the neutral mode. In the forward mode, the propeller 56 rotates in a rotational direction that propels the watercraft 37 forwardly. In the reverse mode, the propeller 56 rotates in the reversed rotational direction that propels the watercraft 37 backwardly. In the neutral mode, the propeller 56 does not rotate and does not propel the watercraft 37. In this description, the operational mode of the propeller 56 can be called as "shift mode."

Additionally, the watercraft 37 has a steering mechanism (not shown) that includes a steering wheel disposed at, for example a cockpit. The steering wheel is connected to the outboard motor 32 so as to pivot the swivel bracket relative to the clamping bracket when the operator operates the steering wheel. The watercraft 37 thus can turn to the right or left direction.

With reference back to FIG. 1, the ECU 90 controls at least the servo motor 88, the fuel injectors 92, the spark plugs 140, the pre-pressurizing pump 108, the exhaust valve actuator 154, the lubrication pump 168, the lubricant supply pump 174 and the lubricant delivery pump 186 and the shift rod actuator 212. In order to control at least some of those components, the outboard motor 32 has a number of sensors that sense either engine running conditions, ambient conditions or conditions of the outboard motor 32.

For example, there is provided a crankshaft angular position sensor 216 that senses a crankshaft angular position and outputs a crankshaft angular position signal to the ECU 90. The ECU 90 can calculate an engine speed using the crankshaft angular position signal versus time. In this regard, the crankshaft angular position sensor 216 and part of the ECU 90 form an engine speed sensor.

Operator's demand or engine load, as determined by the angular position of the throttle valve 84, is sensed by a throttle valve position sensor 218 which outputs a throttle valve position or load signal to the ECU 90. In the illustrated embodiment, the output signal from the throttle valve position sensor 218 is used to determine whether an abnormal state occurs in the control of the throttle valves 84.

Preferably, other than those sensors, there are a fuel pressure sensor 220 that detects a fuel pressure in one of the high pressure fuel passages 122, an intake air temperature sensor 222 that detects a temperature of the intake air, a first oxygen ($O_2$) sensor 224 that detects a residual amount of oxygen in the cylinder bore 62, preferably, at the number #1 bore, a second oxygen ($O_2$) sensor 225 that detects a residual amount of oxygen existing downstream of one of the catalysts 158, a water temperature sensor 226 that detects a temperature of the cooling water, a water amount sensor 228 that detects an amount of water removed by the fuel filter 106, an exhaust pressure sensor 230 that detects an exhaust pressure in the exhaust device 142, a lubricant level sensor 232 that detects an amount of lubricant in the main lubricant tank 170, a knock sensor 236 that detects a knocking, an engine body temperature sensor 238 that detects a temperature of the engine body 46, a trim sensor 240 that detects a trim position of the outboard motor 32 relative to the associated watercraft 37 and an ambient air temperature sensor (not shown) that detects an ambient air temperature.

Additionally, a pulsar 242 also is provided at the flywheel magneto. The pulsar 242 generates pulses that provide basic signals of the respective ignition timings.

With reference to the most right-hand view of FIG. 1, the operating unit now is descried below.

As described above, the ECU 90 controls the servo motor 88 and the shift rod actuator 212 based upon the commands (i.e., the desired position of the throttle valves 84 and the desired mode of the propeller 56) provided by the operating unit. The operating unit in this embodiment is a remote controller 246 that is disposed preferably at a cockpit of the watercraft 37 or somewhere in the watercraft 37.

The remote controller 246 preferably is connected to the ECU 90 through a wire or wireless local area network (LAN) 248, which is a communication device. The remote controller 246 has a transferring control section to communicate the LAN 248. The LAN 248 can connect other devices or components with each other. For instance, a display panel, which is described below, can be connected to the ECU 90 through the LAN 248. The remote controller 246, the display panel and other devices or components in the LAN 248 are nodes of the LAN 248.

The remote controller 246 preferably has a control lever 250 that is journaled on a housing of the remote controller 246 for pivotal movement. The control lever 250 is operable by the operator so as to pivot between two limit ends. A reverse troll position R, a neutral position N, a forward troll position F and an acceleration range E can be selected in this order between the limit ends. One limit end corresponds to the reverse troll position R, while the other limit end corresponds to the end of the acceleration range E. Preferably, the control lever 250 stays at any position between the limit ends unless the operator operates the lever 250.

The remote controller 246 also has a reverse troll switch 256, a forward troll switch 258 and an acceleration position sensor 260. The reverse troll switch 256 preferably is a normally open switch and can be closed when the control lever 250 is set at the reverse troll position R. The forward troll switch 258 preferably is a normally open switch and can be closed when the control lever 250 is set at the forward troll position F. The acceleration position sensor 260 preferably is a rotary potentiometer, an optical encoder or the like that outputs signals corresponding to an angular position within the acceleration range E.

The remote controller 246 commands the ECU 90 to set the shift position at the reverse mode of the propeller 56 and also to set the throttle valves 84 at the idle position θidl (i.e., almost closed position) when the control lever 250 is set at the reverse troll position R. The remote controller 246 commands the ECU 90 to set the shift position at the neutral mode of the propeller 56 and also to set the throttle valves 84 at the idle position θidl. The remote controller 246 commands the ECU 90 to set the shift position at the forward mode of the propeller 56 and also to set the throttle valves 84 at the idle position θidl. The remote controller 246 commands the ECU 90 to set the shift position at the forward mode of the propeller 56 and also to set the throttle valves 84 at any position greater than the idle position θidl and corresponding to an angular position of the control lever 250 in the acceleration range E.

The remote controller 246 or the LAN 248 can malfunction. If such an abnormal state occurs, the desired shift and throttle valve positions cannot be transferred to the ECU 90. In the illustrated embodiment, the watercraft 37 also includes an auxiliary controller 264 as an auxiliary operating unit for use during a malfunction so that the shift and throttle valve positions in corresponding to the desired shift and throttle valve positions can be transmitted to the ECU 90 even under the abnormal condition. The auxiliary controller 264 can be formed with, for example, a rotary potentiometer. The LAN 248 preferably has an open node 266 for the auxiliary controller 264. The operator can connect the auxiliary controller 264 to the open node 266 and then the auxiliary controller 264 can transfer the shift and throttle valve positions in emergency to the ECU 90.

In one variation, the ECU 90 can have an input port or connector to which the auxiliary controller 264 can be directly connected. The auxiliary controller 264 can directly (i.e., not through the LAN 248) transfer the shift and throttle valve positions in to the ECU 90 when the operator connects the auxiliary controller 264 to the input port of the ECU 90. In this variation, the auxiliary controller 264 preferably has a proper interface to communicate with the ECU 90.

The watercraft 37 preferably has a display panel 270 at the cockpit or any other place where the operator normally resides. The illustrated display panel 270 preferably comprises a liquid crystal display (LCD), although any other display devices such as, for example, a cathode ray tube can be used. Various engine and environmental conditions that are sensed by the foregoing sensors can be indicated at the display panel 270. Operational modes of the propeller 56 preferably are indicated on the display panel 270. The display panel 270 can indicate any other information that is necessary for operating the watercraft 37 and/or the outboard motor 32. For example, some guides or manuals can be displayed. As noted above, the display panel 270 can be connected to the ECU 90 through the LAN 248.

The watercraft 37 preferably has an alarming device 272 at the cockpit or any other place in the watercraft 37 to alert the operator that an abnormal state(s) occur in the watercraft propulsion system 30. The alarming device 272 can be an indicator, a sounder or both. The indicator can be a visual device that visually indicates the abnormal states. Some color lights, for example, a red light, can form the indicator. The indicator can indicate the abnormal state(s) continuously or intermittently. The indicator can be a part of the display panel 270 or be independently provided apart from the display panel 270.

The sounder, in turn, can include a buzzer, speaker or any other devices that alarms with sound or voice. The voice can be recorded actual human voice or composite voice made artificially. The sounder can sounds continuously or intermittently. The sound can become gradually louder. The indicator or the voice sounder can provide guidance that tells the emergency situation and/or proper procedures to recover the situation. A plurality of alarming devices 272 can be provided to inform different abnormal states. Any other conventional indicators or sounders can be used as the alarming device 272.

Figure 3:
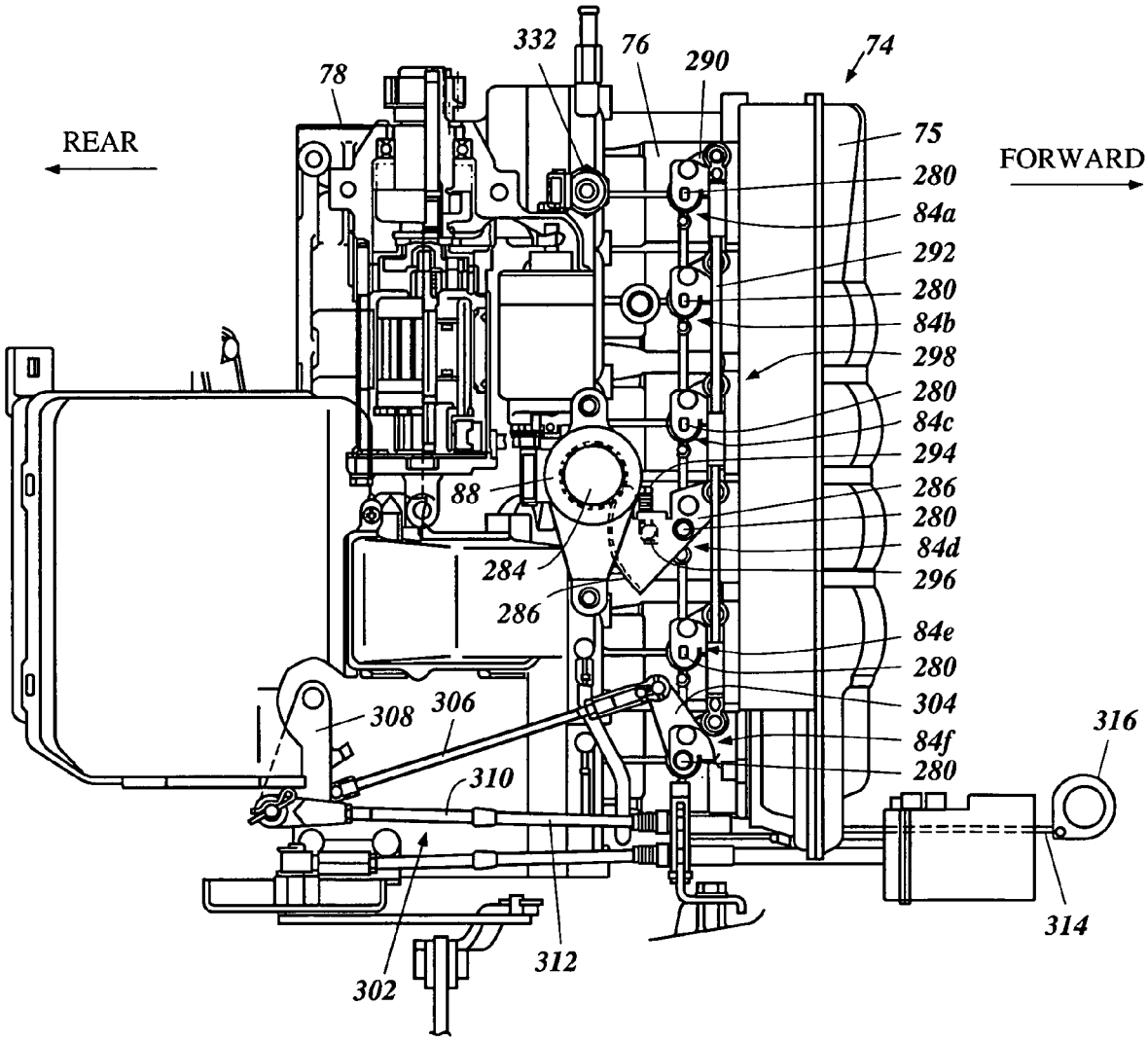
FIG. 3 is a partial port side elevational view of the engine with a protective cowling detached, showing a primary air intake device that has a throttle valve servomechanism that connects throttle valves of the engine with each other and a servo motor that actuates the throttle valves through a control linkage, wherein a manually operated throttle valve control mechanism for use during a throttle valve failure also is shown.
Figure 4:
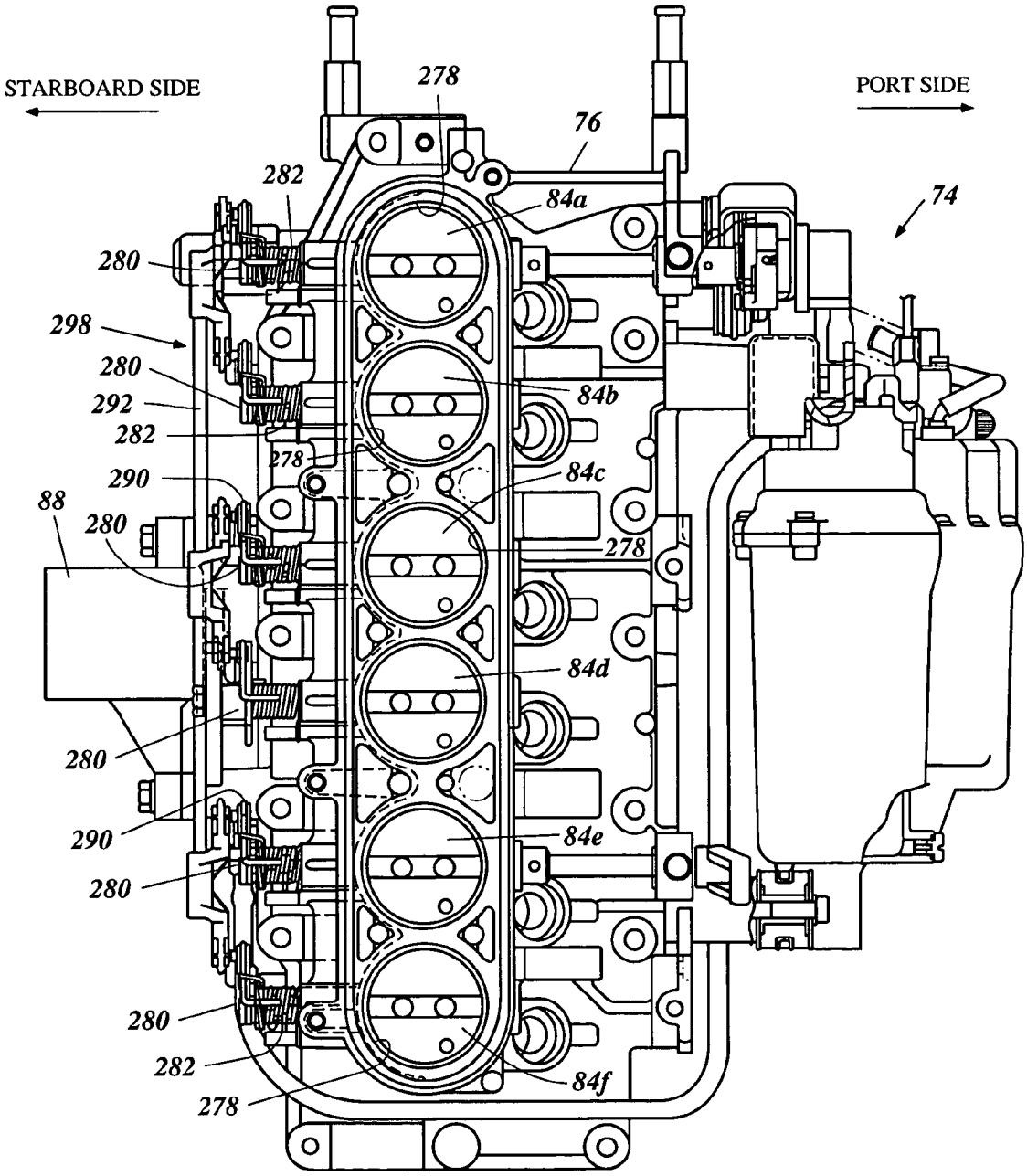
FIG. 4 is a front elevational view of the engine with a plenum chamber member of the primary air intake device removed, particularly showing a throttle body that incorporates the throttle valves.
Figure 5:
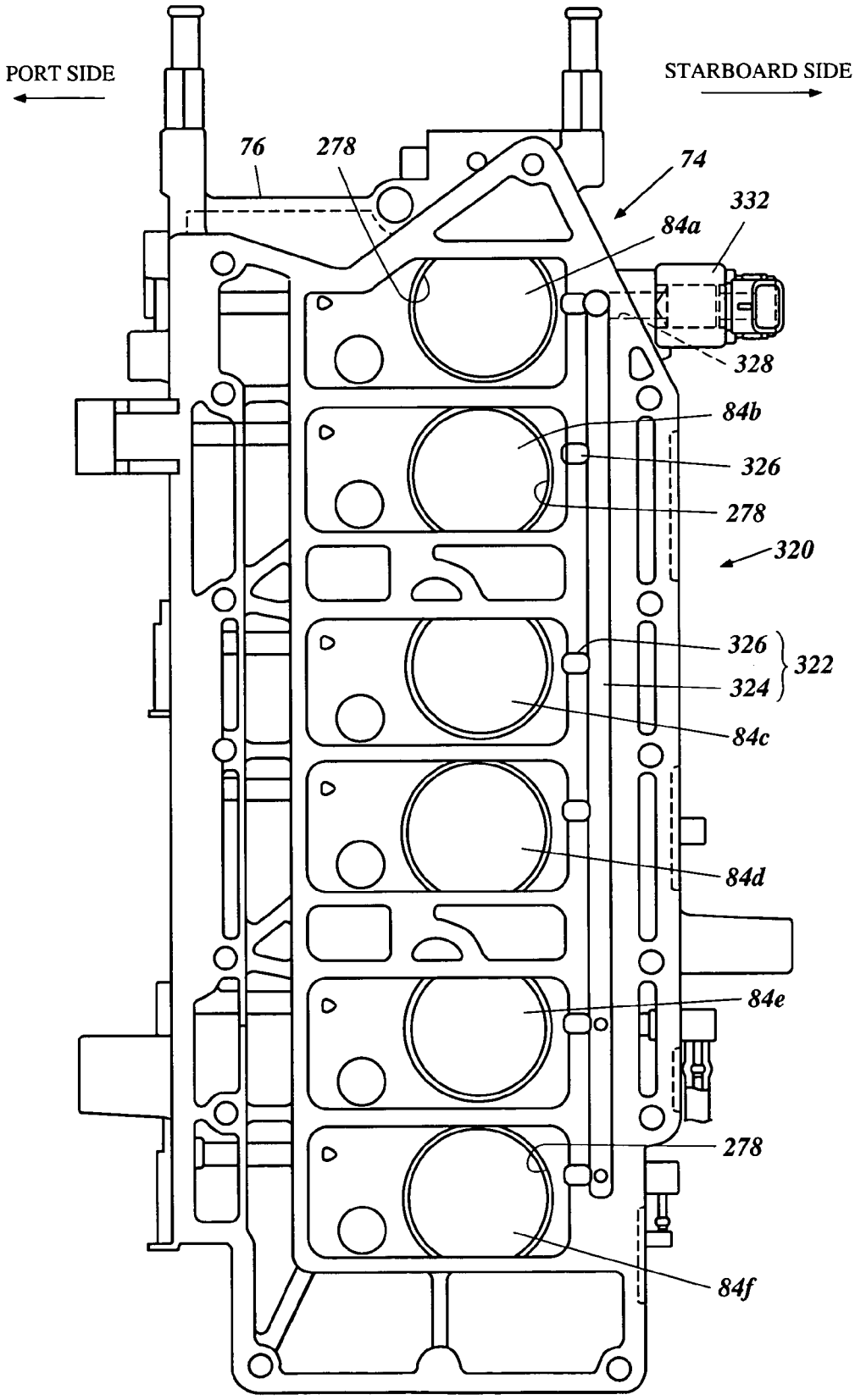
FIG. 5 is a rear elevational view of the engine with an intake conduit of the primary air intake device removed, particularly showing the throttle body defining a portion of a secondary air intake device.

With reference to FIGS. 3–5, the major part of the primary air intake device 74 that includes the throttle valves 84 is described below.

As described above, the throttle body 76 and the air intake conduit 78 defines six air passages that extend generally horizontally and spaced apart vertically with each other. The air passages are designated by the reference numeral 278 in FIGS. 4–6. Each throttle valve 84 is journaled within each air passage 278. The throttle valves 84 are designated with individual reference numerals 84*a*, 84*b*, 84*c*, 84*d*, 84*e*, 84*f* from the top to the bottom in FIGS. 4–6.

With particular reference to FIGS. 3 and 4, each throttle valve 84*a*, 84*b*, 84*c*, 84*d*, 84*e*, 84*f* preferably has a valve shaft 280 extending generally horizontally and journaled on the throttle body 76. A bias spring 282 is disposed at each valve shaft 280 to urge the associated throttle valve 84*a*, 84*b*, 84*c*, 84*d*, 84*e*, 84*f* toward the closed position. In other words, the throttle valves 84*a*, 84*b*, 84*c*, 84*d*, 84*e*, 84*f* normally are placed at the closed positions unless the servo motor 88 actuates the throttle valves 84*a*, 84*b*, 84*c*, 84*d*, 84*e*, 84*f*.

Preferably, the servo motor 88 is mounted on a side surface of the throttle body 76 and is disposed adjacent to the throttle valve 84*d*. The valve actuator 88 has a drive gear 284 that rotates about a horizontal axis when the valve actuator 88 is activated. The drive gear 284 is disposed on an outer surface of the valve actuator 88 that faces the throttle body 76. The valve shaft 280 of the throttle valve 84*d* has a driven gear 286 that is affixed to an outer end of the valve shaft 280. The driven gear 286 preferably is generally configured as a fan-shape. The driven gear 286 meshes the drive gear 284 so as to rotate with the valve shaft 280. Thus, the throttle valve 84*d* can move between the closed position and the open position.

Each valve shaft 280 of the other throttle valves 84*a*, 84*b*, 84*c*, 84*e*, 84*f* has a lever 290 at each outer end on the same side as the driven gear 284 affixed to the outer end of the valve shaft 280 of the throttle valve 84*d*. A linkage rod 292 couples the entire levers 290 with each other and also with the driven gear 286. Because of this connection, the respective levers 290 move together with the driven gear 286. Accordingly, the entire throttle valves 84*a*, 84*b*, 84*c*, 84*d*, 84*e*, 84*f* move between the closed position and the open position all together.

An idle adjustment screw 294 preferably is provided on the driven gear 286. The throttle body 76 has a stopper 296 extending generally horizontally toward the driven gear 286 to receive the bottom end of the adjustment screw 294. An anti-clockwise movement of the driven gear 286 in the view of FIG. 3, which brings the throttle valve 84*d* toward the closed position, thus is regulated by the adjustment screw 294 because the adjustment screw 294 abuts the stopper 296 when the driven gear 286 moves anti-clockwise. If the adjustment screw 294 is placed at an adjustment position, not only the throttle valve 84*d* but also the other throttle valves 84*a*, 84*b*, 84*c*, 84*e*, 84*f* do not move to the fully closed position even though the bias springs 282 urges the throttle valves 84*a*, 84*b*, 84*c*, 84*d*, 84*e*, 84*f* to the fully closed position. Thus, a certain amount of air is allowed to flow to the combustion chambers at idle. The regulated position of the throttle valves 84*a*, 84*b*, 84*c*, 84*d*, 84*e*, 84*f* is the idle position or idle opening degree θidl As thus constructed, the drive gear 284 rotates when the valve actuator 88 is activated. The driven gear 286 rotates clockwise when the drive gear 284 rotates anti-clockwise. The throttle valve 84*d* moves toward the open position from the idle position θidl with the driven gear 286 rotating clockwise. Simultaneously, the other throttle valves 84*a*, 84*b*, 84*c*, 84*e*, 84*f* move toward the open position from the idle position θidl because the throttle valves 84*a*, 84*b*, 84*c*, 84*e*, 84*f* are connected to the driven gear 286 through the linkage rod 292 and the respective levers 290. On the other hand, the driven gear 286 rotates anti-clockwise when the drive gear 284 rotates clockwise. The throttle valve 84*d* moves toward the idle position θidl from the open position with the driven gear 286 rotating anti-clockwise. The other throttle valves 84*a*, 84*b*, 84*c*, 84*e*, 84*f* also move toward the idle position θidl from the open position together with the throttle valve 84*d*.

The throttle valves 84, servo motor 88, the valve shafts 280, the drive gear 284, the driven gear 286, the levers 290, the linkage rod 292, the idle adjustment screw 294 and the stopper 296 are part of a throttle valve servomechanism 298 in this arrangement. The throttle valve servomechanism 298 is one example of the foregoing operating mechanism. Other mechanisms can replace the throttle valve servomechanism 298. For instance, another electric motor can replace the servo motor in some arrangements.

Furthermore, the illustrated throttle valve servomechanism 298 is easily interchangeable with a pure mechanical throttle valve drive mechanism because only some members are different in those mechanisms. That is, the pure mechanical mechanism has mechanical linkage members. On the other hand, the servomechanism 298 has the servo motor 88 and related members such as the drive and driven gears 284, 286 that can replace the mechanical linkage members. Because a basic structure of the throttle body 76 can be common both to the pure mechanical mechanism and to the servomechanism 298, the servomechanism 298 can be inexpensively manufactured.

The primary air intake device 74 preferably has an auxiliary throttle valve control mechanism 302 that can be manually operated. The auxiliary mechanism 302 preferably comprises a control lever 304, a first rod 306, an intermediate lever 308, a second rod 310, a guide tube 312 and a push-pull cable 314.

The control lever 304 is affixed to the outer end of the valve shaft 280 of the throttle valve 84*f* together with the lever 290. The intermediate lever 308 is pivotally affixed onto a rear portion of the intake conduit 78. The first rod 306 extends between the control lever 304 and the intermediate lever 308. A front end of the first rod 306 is affixed to a free end of the control lever 304, while a rear end of the first rod 306 is affixed to a free end of the intermediate lever 308. The guide tube 312 is mounted on a bottom portion of the throttle body 76 and extends generally horizontally forward to rear. The second rod 310 extends through the guide tube 312. A rear end of the second rod 310 is affixed to the free end of the intermediate lever 308 together with the first rod 306. The push-pull cable 314 is coupled with a front end of the second rod 310 and extends forward so as to end at an external location of the protective cowling assembly. A ring-shaped handle 316 preferably is affixed at a front end of the push-pull cable 314. The operator can pull the push-pull cable 314 with the ring-shaped handle 316 in the watercraft 37.

In the event of malfunction such that the throttle valves 84 do not satisfactorily follow the movement of the servomechanism 298, an operator can pull the push-pull cable 314 to open the throttle valves 84*a*, 84*b*, 84*c*, 84*d*, 84*e*, 84*f*.

The second rod 310 moves forward through the guide tube 312. The intermediate lever 308 thus swings to push the first rod 306 generally forward. The control lever 304 rotates clockwise and the throttle valve 84*f* moves toward the open position. Simultaneously, the other throttle valves 84*a*, 84*b*, 84*c*, 84*d*, 84*e* also are moved toward the open position through the linkage rod 292 and the levers 290. Meanwhile, if the operator pushes the push-pull cable 314, the throttle valves 84*a*, 84*b*, 84*c*, 84*d*, 84*e*, 84*f* move toward the closed position as all the components of the control mechanism 302 move oppositely. Accordingly, the throttle valves 84*a*, 84*b*, 84*c*, 84*d*, 84*e*, 84*f* are manually operated whenever the operator wants to change the throttle valve position in any situation, and advantageously, in the event of a failure of the servomechanism 298 or device preventing the normal operation of the throttle valves 84*a*, 84*b*, 84*c*, 84*d*, 84*e*, 84*f*.

With continued reference to FIGS. 3–5 and particular reference to FIG. 5, the engine 40 preferably is provided with a secondary air intake device 320 to deliver at least a minimum amount of air to the combustion chambers sufficient to maintain operation of the engine 40 in the event such that the primary intake device 74 fails and thus does not deliver sufficient air to the combustion chambers. In the illustrated embodiment, the secondary intake device 320 comprises first and second portions. The first portion comprises a bypass passage 322 formed between the downstream end of the throttle body 76 and an upstream end of the intake conduit 78. The second portion comprises the air passages 278 downstream of the throttle valves 84. In other words, the air passages 278 downstream of the throttle valves 84 act as part of the primary intake device 74 and also as part of the secondary intake device 320. In one alternative, the secondary intake device 320 can have its own passage that is directly connected to the combustion chambers without using the throttle valve downstream portion of the primary air intake device 74.

The bypass passage 322 preferably comprises a main groove 324, branch grooves 326 and a through-hole 328. The main and branch grooves 324, 326 preferably are formed on the downstream surface of the throttle body 76. The main groove 324 preferably extends generally vertically along the respective air passages 278 on the starboard side, while the branch grooves 326 extend to the respective air passages 278 from the main groove 324. The through-hole 328 extends generally horizontally from a top end of the main groove 324 through a side wall of the throttle body 76. The bypass passage 322 thus communicates with a location outside of the throttle body 76 through the through-hole 328.

The illustrated secondary intake device 320 additionally comprises a control valve unit or bypass valve unit 332 affixed to the throttle body 76 next to the through-hole 328. The control valve unit 332 defines a through-hole that communicates with the through-hole 328 on one end and with the outside location on the other end. The control valve unit 332 preferably incorporates an electromagnetic solenoid valve that selectively moves between closed and open positions. The bypass passage 322 does not communicate with the outside location when the solenoid valve is in the closed position, while the bypass passage 322 communicates with the outside location when the solenoid valve is in the open position. The ambient air can be drawn into the bypass passage 322 when the solenoid valve is in the open position.

In one variation, the grooves 324, 326 can be formed on the upstream surface of the intake conduit 78. The through-hole 328 preferably is formed at the intake conduit 78 in this variation. In another variation, both the downstream surface of the throttle body 76 and the upstream surface of the intake conduit 78 together form the grooves 324, 326 therebetween. The through-hole 328 can be formed either at the throttle body 76 or the intake conduit 78 in this variation.

In another variation, the main groove 324 can be omitted. Instead, the respective branch grooves 326 can extend outwardly to communicate with an external location and each branch groove in this alternative can have its own control valve unit 332. The control valve units in this variation preferably are synchronously operated. In a further variation, the control valve unit 332 can be manually operated. Alternatively further, the bypass passage 322 can be formed with openings rather than the grooves 324, 326.

Figure 6:
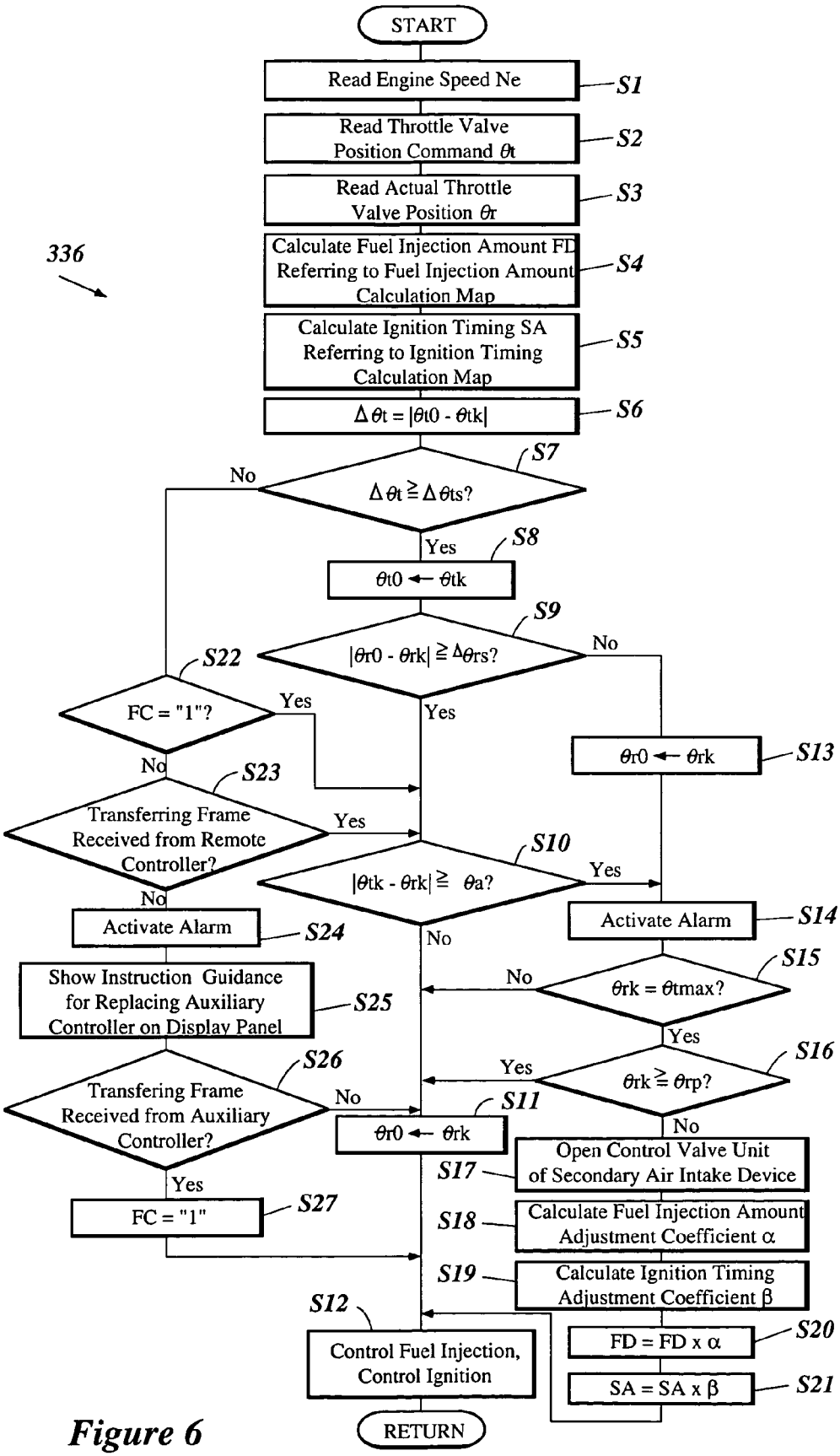
FIG. 6 is a flow chart that shows a control routine for a method that can be used to operate the watercraft propulsion system of FIG. 1.

With reference to FIG. 6, a control routine 336 that can be used for control of the watercraft propulsion system 30 is described below. The control routine 336 can be stored in the storage of the ECU 90.

The routine 336 begins when a switch (not shown) disposed on the outboard motor 32, preferably, at a front surface thereof, is turned on by the operator. The LAN 248 and other devices on the watercraft 37 also are activated when the operator turns a main switch (not shown), which preferably is disposed at the cockpit. The control routine 336 then starts and proceeds to a step S1.

The ECU 90, at the step S1, reads an engine speed Ne that is calculated based upon a crankshaft rotational speed signal sensed by the crankshaft angular position sensor 216. The routine 336 goes to a step S2.

At the step S2, the ECU 90 reads a throttle valve position command θt that is provided from the remote controller 246 when the control lever 250 of the remote controller 246 is positioned at the forward troll position F, the reverse troll position R or in the acceleration range E. Initially, a throttle valve position command reference θt0 is given when the control lever 250 is placed at the forward troll position F. Also, a current throttle valve position command θtk is given when the control lever 250 is placed at a position within the acceleration range E. The current throttle valve position command θtk represents a desired throttle valve position. The routine 336 then goes to a step S3.

The ECU 90, at the step S3, reads an actual throttle valve position θr that is provided from the throttle valve position sensor 218. Initially, an actual throttle valve position reference θr0 is given when the throttle valves 84 are placed at the closed position, which is adjusted by the adjustment screw 294. Also, a current actual throttle valve position θrk is given when the throttle valves 84 are placed at a position between the closed position and the open position. The routine 336 goes to a step S4.

At the step S4, the ECU 90 calculates an amount of fuel FD to be injected by the fuel injectors 92 by referring to a fuel injection amount calculation map 338 of FIG. 7. The fuel injection amount calculation map 338 can be stored in the memory or other storage device of the ECU 90. The fuel injection amount calculation map 338 is a two parameter map in which one specific fuel injection amount FD is determined based upon two parameters which can be the engine speed Ne and the actual throttle valve position θr. The ECU 90 stores the calculated fuel injection amount FD into a storage area or replaces a fuel injection amount FD previously stored if this procedure is a second or later procedure. The routine 336 then proceeds to a step S5.

Figure 8:
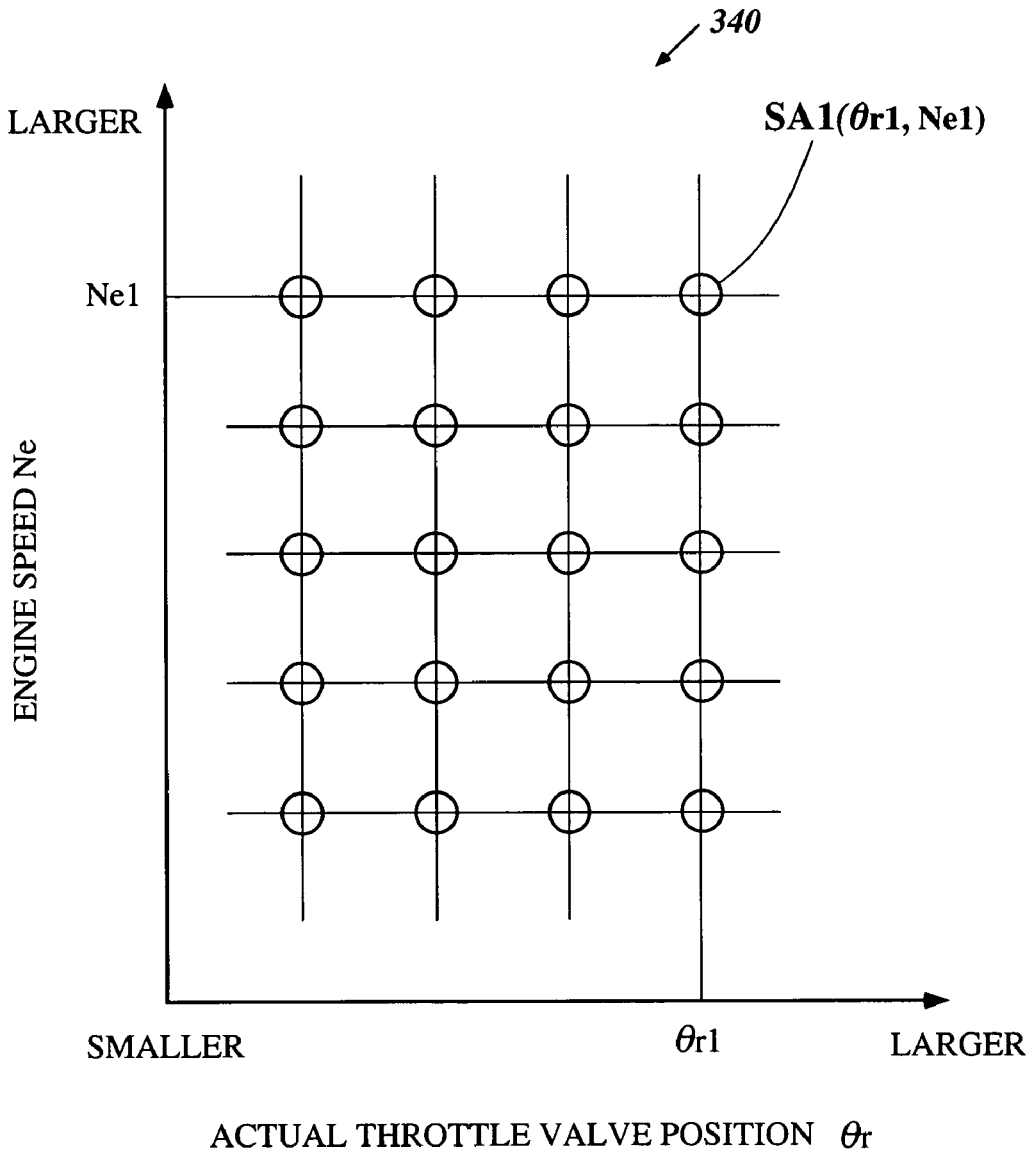
FIG. 8 is an ignition timing calculation map that can be used in conjunction with the control routine of FIG. 6.

The ECU 90, at the step S5, calculates an ignition timing SA of the spark plugs 140 by referring to an ignition timing calculation map 340 of FIG. 8. The ignition timing calculation map 340 is stored in the memory or other storage device of the ECU 90. The ignition timing calculation map 340 is a two parameter map in which one specific ignition timing SA is determined based upon two parameters which can be the engine speed Ne and the actual throttle valve position θr. For example, if the actual throttle valve position θr is θr1 and the engine speed Ne is Ne1, then the ignition timing SA is SA1. The ECU 90 stores the calculated ignition timing SA into a storage area of ignition timing in the storage or replaces an ignition timing SA previously stored if this procedure is a second or later procedure. The routine 336 then proceeds to a step S6.

At the step S6, the ECU 90 calculates a change in the operator's throttle command Δθt that represents the absolute value of the difference between the current throttle valve position command value θtk and a previous value, which is, when the routine initially runs, the throttle valve position command reference θt0. The routine 336 then goes to a step S7.

The ECU 90, at the step S7, determines whether the change amount of command Δθt is equal to or greater than a preset threshold of change amount of command Δθts. If the determination is positive, the ECU 90 recognizes that the throttle valve position command θt has been changed. The routine 336 goes to a step S8.

At the step S8, the ECU 90 sets the current throttle valve position command θtk as a throttle valve position command reference θt0 and stores the current throttle valve position command θtk as a throttle valve position command reference θt0 into a storage area of the throttle valve position command reference. Then, the routine 336 proceeds to a step S9.

The ECU 90, at the step S9, calculates an absolute value of a difference between an actual throttle valve position reference θr0 and a current actual throttle valve position θrk and determines whether the absolute value of the difference is equal to or greater than a preset threshold of actual change amount Δθrs. If the determination is positive, the ECU 90 assumes that the actual throttle valve position θr is normally changed. However, it is possible that the actual throttle valve position θr is not properly following the throttle valve position command θt. The routine 336 thus goes to a step S10.

At the step S10, the ECU 90, calculates an absolute value of a difference between the current throttle valve position command θtk and a current actual throttle valve position θrk, and determines whether the absolute value of the difference is equal to or greater than a preset threshold of abnormal state θa that separates an abnormal state from the normal state. If the determination at the step S10 is negative, the ECU 90 recognizes that the actual throttle valve position θr is properly following the throttle valve position command θt, or that a deviation of the actual throttle valve position θr from the throttle valve position command θt is small enough to be neglected. The routine 336 goes to a step S11.

In one variation, instead of using the preset threshold of abnormal state θa at the step S10, the ECU 90 can compare a change amount of the actual throttle valve position θrk with a change amount of the throttle valve position command θtk. If the change amount of the actual throttle valve position θrk is equal to the change amount of the throttle valve position command θtk, the ECU 90 can determine that the throttle valve position θr properly follows the throttle valve position command θt. If, however, the change amount of the actual throttle valve position θrk is less than the change amount of the throttle valve position command θtk, the ECU 90 can determine that the throttle valve position θr does not properly follow the throttle valve position command θt. In other words, the ECU 90 can determine that some abnormal condition occurs at the throttle valve servomechanism 298.

The ECU 90, at the step S11, sets the current actual throttle valve position θrk as an actual throttle valve position reference θr0 and stores the current actual throttle valve position θrk as an actual throttle valve position reference θr0 into a storage area of actual throttle valve position in the storage. Then, the routine 336 then proceeds to a step S12.

At the step S12, the ECU 90 controls the fuel injectors 92 based upon the fuel injection amount FD stored in the storage at the step S4 and controls the spark plugs 140 based upon the ignition timing SA stored in the storage at the step S5. The routine 336 then returns back to the step S1 to repeat the step S1.

If the determination at the step S9 is negative, i.e., the absolute value of the difference is less than a preset threshold of actual change amount Δθrs, the ECU 90 recognizes that some abnormal state occurs because the actual throttle position θr does not properly follow the throttle valve position command θt. The routine 336 then proceeds to a step S13.

The ECU 90, at the step S113, sets the current actual throttle valve position θrk as an actual throttle valve position reference θr0 and stores the current actual throttle valve position θrk as an actual throttle valve position reference θr0 into the storage area reserved for actual throttle valve position data in the storage device. Then, the routine 336 proceeds to a step S14.

At the step S14, the ECU 90 operates the alarming device 272. The alarming device 272 thus sounds and/or indicates the abnormal state. The operator thus can understand that the watercraft 37 is under a malfunction condition that requires the watercraft 37 to "limp home." Then, the routine 336 goes to a step S15.

At the step S15, the ECU 90 determines whether the current throttle valve position command θtk is equal to the maximum throttle valve position command θtmax (normally, corresponding to the fully open position). If the determination at the step S15 is negative, i.e., the current actual throttle valve position θrk is less than the maximum throttle valve position command θtmax, the ECU 90 assumes that the operator recognizes that the engine 40 operates at a sufficient engine speed, and the routine 336 goes to the step S11 to conduct the step S11. If the determination at the step S15 is positive, i.e., the current actual throttle valve position θrk is set at the maximum throttle valve position command θtmax, the ECU 90 assumes that the operator recognizes that the engine speed is insufficient, and the routine 336 proceeds to a step S16.

The ECU 90, at the step S16, determines whether the current actual throttle valve position θrk is equal to or greater than a preset threshold of actual throttle valve position θrp that separates throttle valve position that is insufficient to create an engine speed for the limp home operation from other throttle valve positions that are sufficient to do the same. In general, each engine has its own threshold of actual throttle valve position θrp. For example, the threshold of actual throttle valve position θrp for a relatively large size two stroke engine is approximately 20 degrees.

If the determination at the step S16 is positive, i.e., the current actual throttle valve position θrk is equal to or greater than a preset threshold of actual throttle valve position θrp, the ECU 90 recognizes that the primary air intake device 74 can obtain a sufficient air amount or at least a certain air amount that is necessary for limp home operation. The routine 336 then goes to a step S11 to conduct the step S11.

If the determination at the step S16 is negative, i.e., the current actual throttle valve position θrk is less than a preset threshold of actual throttle valve position θrp, the ECU 90 recognizes that the primary air intake device 74 cannot obtain an air amount that is sufficient for limp home operation. That is, the current actual throttle valve position θrk is closer to the closed position than the open position. More specifically, the current actual throttle valve position θrk is located in a range between the preset threshold of actual throttle valve position θrp and the closed position. The routine 336 goes to a step S17.

At the step S17, the ECU 90 controls the solenoid valve of the control valve unit 332 of the secondary air intake device 320 to move to the open position. The secondary air intake device 320 thus is added to supply supplemental air to the combustion chambers. The minimum amount of air that is sufficient to maintain the engine operation thus can be ensured. Then, the routine 336 then goes to a step S18.

Figure 9:
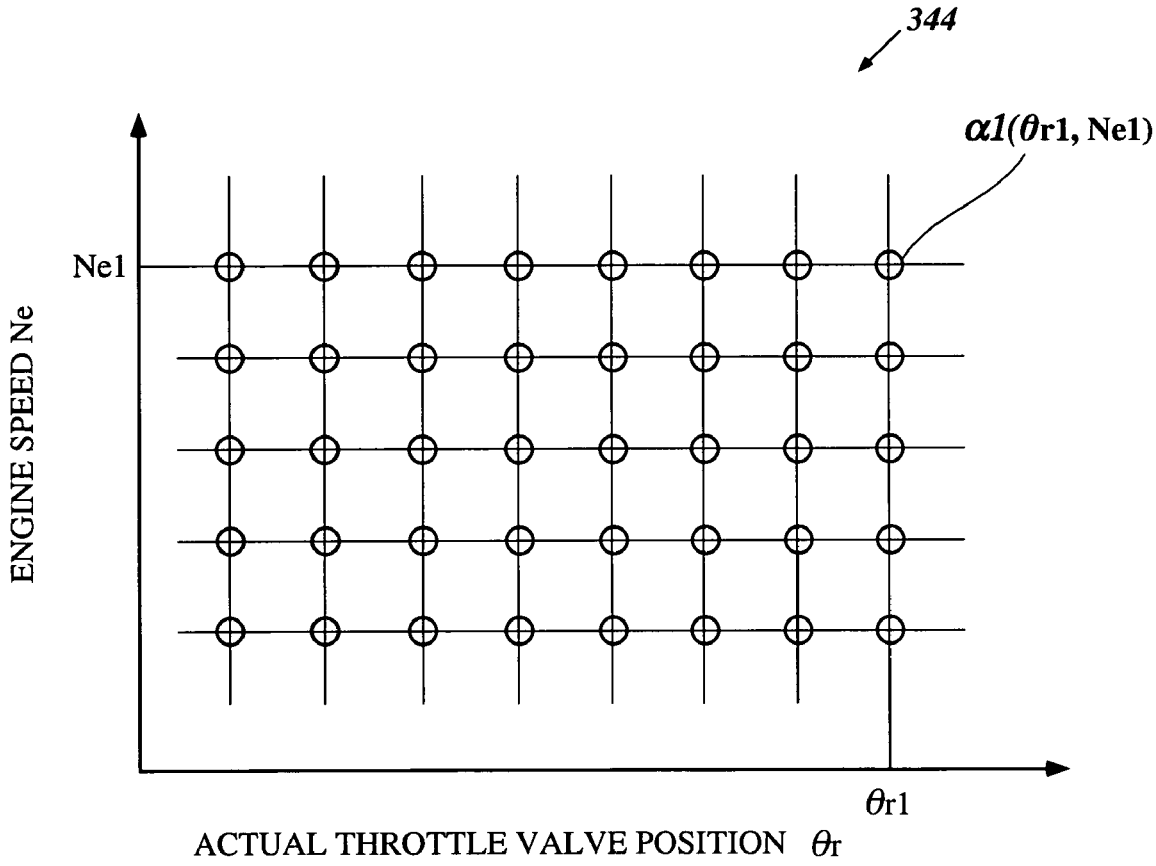
FIG. 9 is a fuel injection amount adjustment coefficient calculation map that can be used in conjunction with the control routine of FIG. 6.

The ECU 90, at the step S18, calculates a fuel injection amount adjustment coefficient α (α>1) that can be used to calculate an adjusted fuel injection amount FD by referring to a fuel injection amount adjustment coefficient calculation map 344 of FIG. 9. More specifically, the fuel injection amount adjustment coefficient α is used to increase the fuel injection amount FD in accordance with the increase of the air amount that is made by the addition of the secondary intake device 320.

The fuel injection amount adjustment coefficient calculation map 344 is stored in the memory or other storage device of the ECU 90. The fuel injection amount adjustment coefficient calculation map 344 can be a two parameter map in which one specific fuel injection amount adjustment coefficient α is determined based upon two parameters which are the engine speed Ne and the actual throttle valve positions θr. For example, if the actual throttle valve position θr is θr1 and the engine speed Ne is Ne1, then the fuel injection amount adjustment coefficient α is α1. The ECU 90 stores the calculated fuel injection amount adjustment coefficient α into a storage area of fuel injection amount adjustment coefficient in the storage or replaces a fuel injection amount adjustment coefficient α previously stored if this procedure is a second or later procedure. Then the routine 336 proceeds to a step S19.

Figure 10:
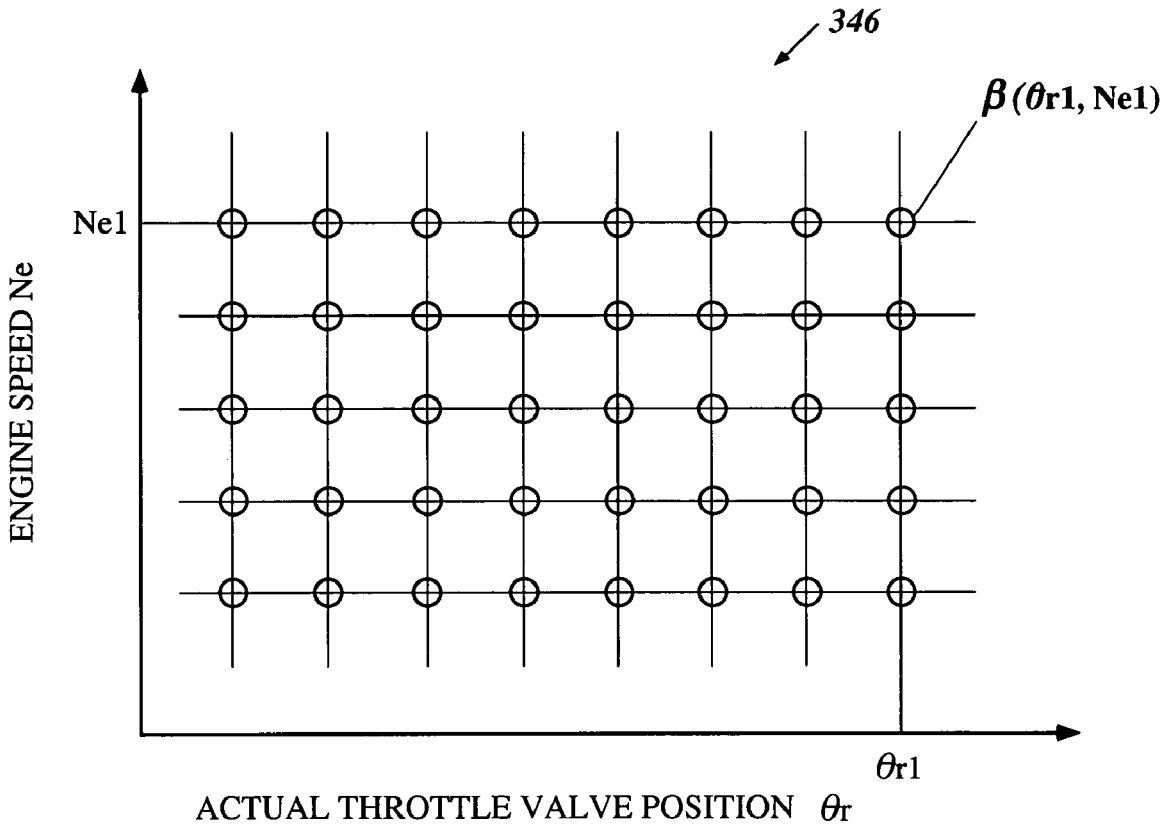
FIG. 10 is an ignition timing adjustment coefficient calculation map that can be used in conjunction with the flow chart of FIG. 6.

At the step S19, the ECU 90, calculates an ignition timing adjustment coefficient β (β>1) that can be used to calculate an adjusted ignition timing SA by referring to an ignition timing adjustment coefficient calculation map 346 of FIG. 10. More specifically, the ignition timing adjustment coefficient β is used to advance the ignition timing SA in accordance with the increase of the air amount that is made by the addition of the secondary intake device 320. The ignition timing SA is advanced using the ignition timing adjustment coefficient β preferably in a range where the timing advance does not cause any knocking phenomenon.

The ignition timing adjustment coefficient calculation map 346 is stored in the storage of the ECU 90. The ignition timing adjustment coefficient calculation map 346 can be a two parameter map in which one specific ignition timing adjustment coefficient β is determined based upon two parameters which are the engine speed Ne and the actual throttle valve positions θr. For example, if the actual throttle valve position θr is θr1 and the engine speed Ne is Ne1, then the ignition timing adjustment coefficient β is β1. The ECU 90 stores the calculated ignition timing adjustment coefficient β into a storage area of ignition timing adjustment coefficient in the storage or replaces an ignition timing adjustment coefficient β previously stored if this procedure is a second or later procedure. Then the routine 336 proceeds to a step S20.

The ECU 90, at the step S20, calculates the adjusted fuel injection amount FD by multiplying the initial or previous fuel injection amount FD by the fuel injection amount adjustment coefficient α. The adjusted fuel injection amount FD is stored in the storage of the ECU 90 in place of the initial or previous fuel injection amount FD. Then, the routine 336 goes to a step S21.

At the step S21, the ECU 90 calculates the adjusted ignition timing SA by multiplying the initial or previous ignition timing SA by the ignition timing adjustment coefficient β. The adjusted ignition timing SA is stored in the storage of the ECU 90 in place of the initial or previous ignition timing SA. The routine 336 then goes to the step S12 to conduct the step S12.

With reference again to the step S7, if the determination at the step S7 is negative, i.e., the change amount of command Δθt is less than the preset threshold of change amount of command Δθts, the ECU 90 assumes that the remote controller 246 does not work normally or an abnormal state occurs at a portion of the LAN 248 between the remote controller 246 and the ECU 90. The routine 336 proceeds to a step S22.

At the step S22, is it determined whether a throttle valve position command change flag FC is set to "1." If the determination at the step S22 is positive, the ECU 90 recognizes that the auxiliary controller 264 has been connected to and been used to control the watercraft propulsion system 30 instead of the remote controller 246 and that a throttle valve position command from the auxiliary controller 246 has been received. The routine 336 goes to the step S1 to conduct the step S10. One method that can be used to determine the flag FC value is described below with reference to steps S26 and S27.

If the determination at the step S22 is negative, i.e., the throttle valve position command change flag FC is reset to "0," the ECU 90 recognizes that the auxiliary controller 264 is not being used to control watercraft propulsion system 30, and the routine 336 goes to the step S23.

At the step S23, the ECU 90 determines whether the throttle valve position command θt is normally received from the remote controller 246 through the LAN 248. The determination preferably is made by determining whether a "transferring frame" or "packet" that has an IP address assigned to the remote controller 246 is received within a preset time. If the determination at the step S23 is positive, the ECU 90 recognizes that no abnormal state occurs at the remote controller 246 or the portion of the LAN 248. Thus, the routine 336 goes to the step S10 to conduct the step S10. If the determination at the step S23 is negative, the ECU 90 recognizes that an abnormal state occurs at the remote controller 246 or the portion of the LAN 248, and the routine 336 goes to a step S24.

The ECU 90, at the step S24, operates the alarming device 272 to sound and/or indicate an abnormal state. The sound and/or the indication preferably is different from alarming of the abnormal state at the step S14. For example, a different sounder sounds in a different tone or the same sounder sounds with a different interval. Also, for example, an indicator in different color emits light or the same indicator emits light with a different interval. The operator thus can understand that the remote controller 246 or the portion of the LAN 248 is under an abnormal condition that requires the auxiliary controller 264 to take part in the watercraft propulsion system 30 instead of the remote controller 246. The routine 336 then goes to a step S25.

At the step S25, the ECU 90 controls the display panel 270 to show an instruction guidance encouraging the operator to take necessary steps to exchange the remote controller 246 for the auxiliary controller 246. In this embodiment, the guidance encourages the operator to connect the auxiliary controller 264 to the open node 266 of the LAN 248 or directly to the input port of the ECU 90. The guidance can be made by the voice sounder solely or together with the display panel 270. The program then goes to a step S26.

The ECU 90, at the step S26, determines whether a transferring frame or packet that includes an IP address of the node 266 and the throttle valve position command θt has been received from the auxiliary controller 264. If the determination at the step S26 is negative, the routine 336 goes to the step S11 to conduct the step S11. If the determination at the step S26 is positive, the routine 336 goes to the step S27.

At the step S27, the ECU 90 exchanges the auxiliary controller 264 for the remote controller 246 as the operating unit so as to read the throttle valve position command θt from the auxiliary controller 264 rather than the remote controller 246 afterwards. The ECU 90, also at the step S27, sets the throttle valve position command change flag FC to "1." Then, the routine 336 goes to the step S12 to conduct the step S12.

An operator may begin operation of the outboard motor 30 with both the remote controller 246 and the throttle valve servomechanism 302 working normally, the control lever 250 is set at the neutral position N, both the reverse troll switch 256 and the forward troll switch 258 are turned off, and the throttle valve position command θtk is "0." The shift rod actuator 212 sets the dog clutch unit 206 in the neutral position. Because the dog clutch unit 206 does not engage the forward bevel gear 200 or the reverse bevel gear 202, the propeller 56 is held at the neutral mode and does not rotate. On the other hand, the servo motor 88 is not activated because the throttle valve position command θtk is "0" and the entire throttle valves 84*a* are kept at the idle position θidl by the idle adjustment screw 294 and the stopper 296.

The throttle valve position command θt provided by the remote controller 246 and the actual throttle valve position θr sensed by the throttle valve position sensor 218 are generally consistent with each other. Thus, the throttle valve position command reference θt0 and the actual throttle valve position reference θr0 both are set as "0" at a moment after the control routine 336 starts. Also, at the same moment, the throttle valve position command change flag FC is reset to "0" if the flag FC has been previously set to "1."

The engine speed Ne, the throttle valve position command θt and the actual throttle valve position θr are read at the steps S1–S3. Then, the fuel injection amount FD and the ignition timing SA are calculated using the fuel injection amount calculation map 338 of FIG. 7 and the ignition timing calculation map 340 of FIG. 8, respectively, at the steps S4 and S5.

Because the control lever 250 of the remote controller 246 is placed at the neutral position, the throttle valve position command θt maintains "0." Thus, the change amount of command Δθt, which is the absolute value of difference between the throttle valve position command reference θt0 and the current throttle valve position command θtk, calculated at the step S6 is about "0." The determination at the step S7 is negative because the change amount of command Δθt is less than the preset threshold of change amount of command Δθts. The routine 336 thus goes to the step S22 and the ECU 90 determines that the throttle valve position command change flag FC is not set. The routine 336 goes to the step S23.

The ECU 90 determines at the step S23 that the transferring frame has been received because the remote controller 246 works normally. Accordingly, the routine 336 goes to the step S10.

The ECU 90 determines at the step S10 that the absolute value of difference between the current throttle valve position command θtk and the current actual throttle valve position θrk is less than the preset threshold abnormal state θa because the absolute value of difference is "0." This is because the current throttle valve position command θtk and the current actual throttle valve position θrk both are "0."

The ECU 90 thus sets the current actual throttle valve position θrk as an actual throttle valve position reference θr0 at the step S11. The ECU 90 then controls the fuel injectors 92 and the spark plugs 140 based upon the fuel injection amount FD and the ignition timing SA, respectively, at the step S12. The engine 40 operates at idle because the fuel injection amount FD and the ignition timing SA is set for the idle operation at this moment.

When the operator is ready to cause the watercraft 37 is move, the operator moves the control lever 250 toward the acceleration range E over the forward troll position F. The remote controller 246 detects the shift mode and the throttle valve position command θt from the position of the control lever 250. That is, the shift mode is the forward mode "F" and the throttle valve position command θt is "θtk" that corresponds to the position of the control lever 250 within the acceleration range E. The remote controller 246 then creates a packet or "transferring frame" that includes the IP address of the remote controller 246 as the sender, the IP address of the ECU 90 as the receiver, and the forward mode "F" and the throttle valve position command "θtk" data. The forward mode "F" and the throttle valve position command "θtk" are stored in a data field of the transferring frame. The remote controller 246 transfers the frame to the ECU 90 through the LAN 248.

Upon receiving the transferring frame, the ECU 90 reads the shift mode "F" and the throttle valve position command "θtk" and stores these command data in the storage. The ECU 90 then controls the shift rod actuator 212 to move the dog clutch unit 206 to the forward position. The dog clutch unit 206 thus engages the forward bevel gear 200 to shift the propeller 56 into the forward mode. Also, the ECU 90 controls the servo motor 88 to move the throttle valves 84 to the throttle valve position "θtk." The steps S1–S6 are repeated.

At the step S7, the change amount of command Δθt is greater than the preset threshold of change amount of command Δθts, because the throttle valve position command θtk at this moment is a certain value corresponding to the position within the acceleration range E of the remote controller 246 and the throttle valve position command θtk is greater than the previous throttle valve position command reference θt0, which was "0." The ECU 90 thus stores the throttle valve position command θtk as a current throttle valve position command reference θt0 at the step S8.

The determination at the step S9 is positive because the absolute value of difference between the actual throttle valve position θrk and the previous actual throttle valve position θr0 is greater than the preset threshold of actual change amount Δθrs. The routine 336 thus proceeds to the step S10. The determination at the step S10 is negative because the throttle valve servomechanism 298 works normally in this scenario. The ECU 90 routinely conducts the steps S11 and S12. At the step S12, the fuel injection amount FD and the ignition timing SA are set such that the engine 40 operates to generate the engine speed corresponding to the acceleration state selected by the control lever 250 of the remote controller 246.

During operation of the watercraft 37, abnormal conditions can occur in the throttle valve servomechanism 298. The abnormal states include "binding phenomena" such that the throttle valves 84 do not follow the throttle valve position command θt. In other words, the change amount of the actual throttle valve position is not consistent with the change amount of the throttle valve position command θt and rather is less than the change amount of the throttle valve position command θt. The binding phenomena of the throttle valves 84 can occur if, for example, the servo motor 88 has some trouble due to overheat, or foreign matters clog the members between the servo motor 88 and the throttle valves 84 (e.g., foreign matters are caught at the valve shafts 280). If such abnormal states occur, the ECU 90 triggers the limp home control mode in response to the abnormal states.

Figure 11:
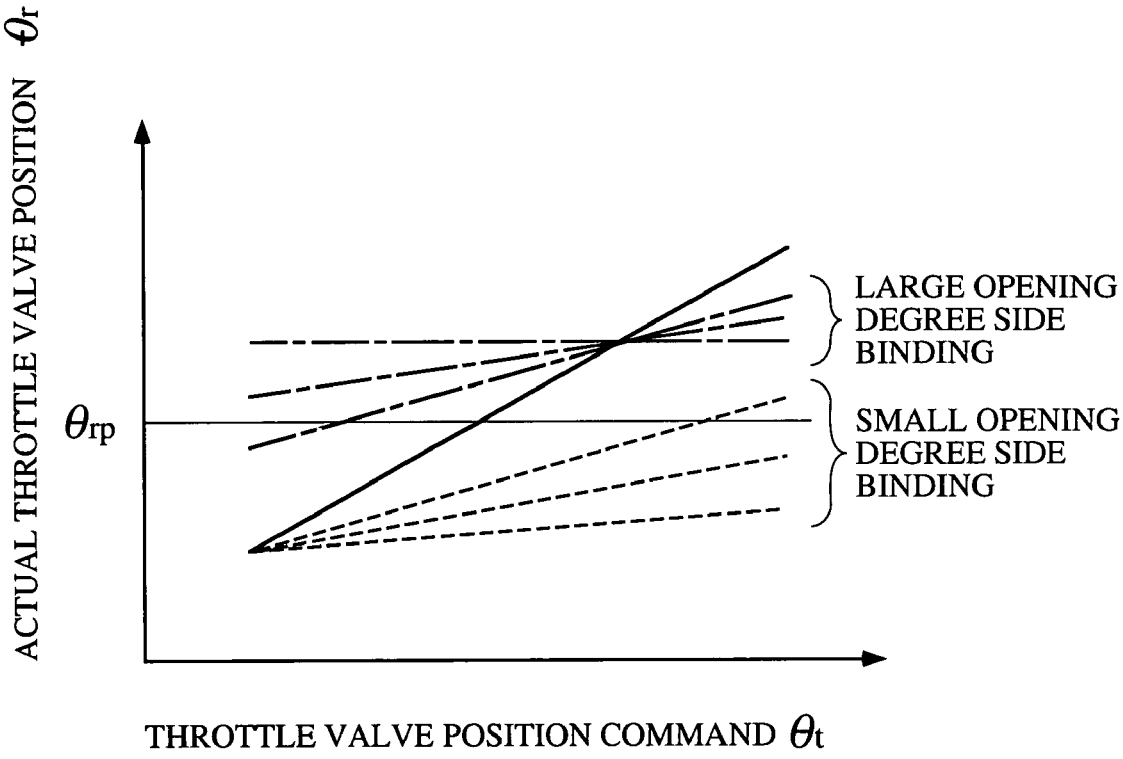
FIG. 11 is an actual throttle valve position θr of the throttle valves versus a throttle valve position command θt, wherein the solid line represents a normal change of the actual throttle valve position θr, the dotted lines represent abnormal changes of the actual throttle valve position θr that occur in a small opening degree side binding phenomenon, and the dash-line represents abnormal changes of the actual degree θr that occur in a large opening degree side binding phenomenon.

With reference to FIG. 11, the binding phenomena include a small opening degree side binding phenomenon and a large opening degree side binding phenomenon. The solid line of FIG. 11 reflects normal operation in which the actual throttle valve position changes entirely consistently with the throttle valve position command θt.

The dotted lines of FIG. 11 show three types of the small opening degree side binding phenomena in which the actual throttle valve position does not follow the throttle valve position command θt and stays at a relatively small opening degree side or almost the closed position (i.e., idle position θidl). FIG. 11 illustrates the preset threshold of actual throttle valve position θrp. Almost the entire part of the actual throttle valve position in the small opening degree side binding phenomenon is smaller than the preset threshold of actual throttle valve position θrp.

The dash chain lines of FIG. 11 show three types of the large opening degree side binding phenomena in which the actual throttle valve position does not follow the throttle valve position command θt and stays at a relatively large opening degree side or the fully open position.

In both the small opening degree side and large opening degree side binding phenomena, the change amount of the actual throttle valve position is less than the change amount of the throttle valve position command θt or can be almost or equal to zero in some states.

Even when the small or large opening degree side binding phenomenon occurs, the ECU 90 conducts the steps S1–S5 as usual under the normal condition. The ECU 90 also conducts the steps S6 and S7. The determination at the step S7 becomes positive when the operator moves the control lever 250 within the acceleration range E and the throttle valve position command θt exceeds the preset threshold of change amount of command Δθts. The ECU 90 sets the throttle valve position command θtk as a current throttle valve position command θt0 at the step S8.

If the actual throttle valve position θr does not follow the throttle valve position command θt, the determination at the step S9 becomes negative. In other words, the ECU 90 recognizes that the throttle valve position command has changed more than the predetermined threshold value Δθts, but the actual throttle valve position has not changed by more than the predetermined threshold value Δθrs. The routine 336 thus goes to the step S13.

At the step S13, the ECU 90 sets the actual throttle valve position θrk as a current actual throttle valve position θr0. The determination at the step S9, however, can be positive if the actual throttle valve position θrk is large enough so that the absolute value between the actual throttle valve position reference θr0 and the actual throttle valve position θrk exceeds the preset threshold of actual change amount Δθrs. In this situation, the routine 336 goes to the step S10. The determination at the step S10 is positive because the actual throttle valve position θr does not follow the throttle valve position command θt.

After the step S13 or the determination at the step S10 is positive, the routine 336 goes to the step S14. The ECU 90 controls the alarming device 272 to sound and/or indicate an abnormal state, and more preferably, provides an indication of the type of failure or malfunction.

Next, the routine 336 proceeds to the step S15 in which the ECU 90 can determine whether the throttle valve position command θtk reaches the maximum throttle valve position command θtmax, which corresponds to the maximum value of the acceleration range E (normally, corresponding to the fully open position). If the determination at the step S15 is negative, presumably the operator is satisfied with the engine speed to limp home and does not require a higher engine speed. The ECU 90 thus conducts the steps S11 and S12 as the normal control. The fuel injection amount FD and the ignition timing SA are those calculated at the steps S4 and S5, respectively.

If the determination at the step S15 is positive, the operator has moved the control lever 250 to the maximum position within the acceleration range E to require a higher engine speed. The routine 336 goes to the step S16.

If the large opening degree side binding phenomenon has occurred, the actual throttle valve position θrk will likely be greater than the preset threshold of actual throttle valve position θrp, and thus will be sufficient to produce an engine speed that is sufficient for to limp home mode operation. The determination at the step S16 thus is positive and the ECU 90 conducts the steps S11 and S12 as the normal control.

If the small opening degree side binding phenomenon has occurred, the actual throttle valve position θrk will likely be less than the preset threshold of actual throttle valve position θrp. Thus when the actual throttle valve position θrk is compared with the preset threshold of actual throttle valve position θrp at the step S16 at the step S16, the result will be negative because the small opening degree side binding phenomenon has occurred. If the actual throttle valve position θrk is less than the preset threshold of actual throttle valve position θrp, the air amount is not satisfactory for limp home mode operation.

Under the circumstances, the ECU 90 controls the control valve unit 332 of the secondary air intake device 320 at the step S17 to open the solenoid valve of the control valve unit 322. Accordingly, the air amount is increased because the additional air amount that flows through the secondary air intake device 320 reaches the combustion chambers of the engine 40. The ECU 90 also conducts the steps S18–S21 to increase the fuel injection amount FD and to advance the ignition timing in accordance with the increase of the air amount made by the secondary air intake device 320. The engine 40 thus can operate at a higher engine speed, despite the malfunction preventing the proper response of the actual throttle valve position θt0.

It is possible that an operator will not notice that the small opening degree side or large opening degree side binding phenomenon has occurred. If the operator does not notice the binding phenomenon occurring, the operator will not operate the control lever 250 and the change amount of command Δθt is less than the preset threshold of change amount of command Δθts. Also, the operator might not operate the control lever 250 under some situations, for example, because the operator wishes to continue a current cruising condition. In this situation, the change amount of command Δθt is less than the preset threshold of change amount of command Δθts. The determination at the step S7 thus is negative and the routine 336 goes to the step S22.

The determination at the step S22 is negative because the throttle valve position command change flag FC has been reset to "0". The ECU 90 thus conducts the step S23. The determination at the step S23 is positive because the remote controller 246 works properly and the ECU 90 has received the transferring frame from the remote controller 246. The routine 336 thus goes to the step S10 and the ECU 90 makes the determination at the step S10. The routine 336 then goes to the step S11 or the step S14 in accordance with the determination by the ECU 90 at the step S10.

On the other hand, it is possible that the ECU 90 may not receive the transferring frame from the remote controller 246, due to a failure or other malfunction. For example, the remote controller 246 can lose an electrical power supply connection or communication connection, or experience malfunctions of the reverse troll switch 256, forward troll switch 258 or acceleration position sensor 260. Also, the LAN 248 can have communication troubles that can be caused by, for example, malfunctions of cables or wireless devices. Under such conditions, the determination at the step S7 can be negative because the change amount of command Δθt stays at "0" due to the throttle valve position command θt not being renewed.

The routine 336 thus goes to the step S22 and the ECU 90 determines that the throttle valve position command change flag FC has been reset to "0" at this moment. The ECU 90 thus conducts the step S23. The determination at the step S23 is negative because the ECU 90 does not receive the transferring frame form the remote controller 246 within the preset time. The routine 336 thus goes to the step S24. The ECU 90 controls the alarming device 272 to sound and/or indicate that the remote controller 246 or a portion of the LAN 248 malfunctions.

The ECU 90 then controls the display panel 270 at the step S25 to show the instruction guidance encouraging the operator to take necessary steps to exchange the remote controller 246 for the auxiliary controller 264. In this embodiment, the operator connects the auxiliary controller 264 to the open node 266 of the LAN 248. Upon the auxiliary controller 264 connecting with the system 30, a management node or master node of the LAN 248 assigns an IP address to the node 266. The management node then notifies the IP address of the node 266 to other devices in the LAN 240 and also notifies the IP addresses of the other devices to the node 266. The node 266 thus is activated and will be able to communicate with the devices including the ECU 90. Particularly, the node 266 now is able to transfer its own transferring frame that has the throttle valve position command θt in the data field to the ECU 90.

The determination at the step S26 now is positive. The ECU 90 sets the throttle valve position command change flag FC to "1" at the step S27. The ECU 90 then conducts the step S12 and controls the fuel injectors 92 and the spark plugs 140 as calculated at the steps S4 and S5, respectively.

Because the throttle valve position command change flag FC is set to "1," the determination at the step S22 of the next turn will be positive. Accordingly, the ECU 90 makes the determination of the step S10 after the step S22 and proceeds to the step S11 or the step S14 in accordance with the determination at the step S10.

If the operator wants to set the throttle valves 84 at a position where the operator desires when the small opening degree side or large opening degree side binding phenomenon occurs, the operator can manually operate the auxiliary throttle valve control mechanism 302 shown in FIG. 3. The throttle valves 84*a*, 84*b*, 84*c*, 84*d*, 84*e*, 84*f* are synchronously moved to the desired position through the control mechanism 302 when the operator pulls or pushes the control cable 314 with the ring-shaped handle 316.

Figure 12:
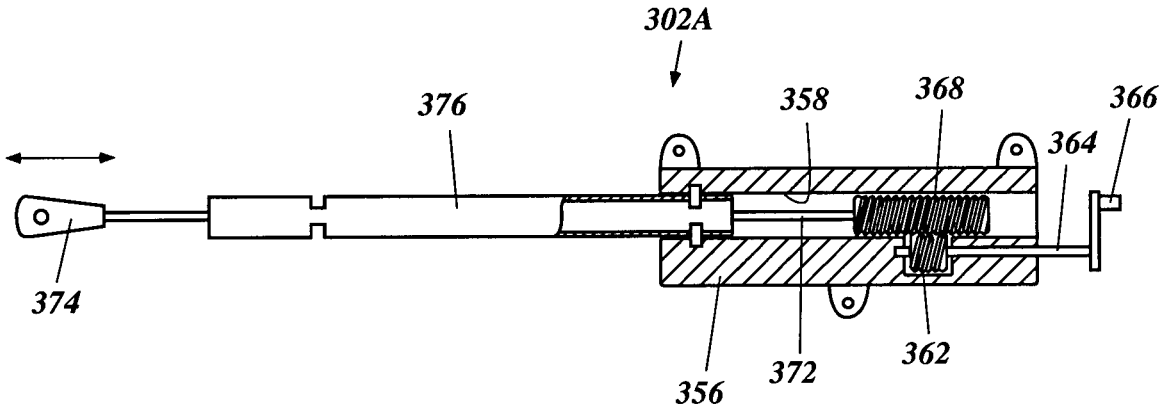
FIG. 12 is a partial sectional and schematic, view of a modification of the manually operated throttle valve control mechanism of FIG. 3.

The auxiliary throttle valve control mechanism 302 can be constructed in any form. FIG. 12 illustrates a modification of the throttle valve control mechanism 302, identified generally by the reference numeral 302A. The control mechanism 302A preferably comprises a tubular casing 356 that is affixed to the protective cowling. An opening 358 extends through the casing 356 and between both ends of the casing 356. An inner recessed portion 360 is formed to communicate with the opening 358. A drive screw 362 is rotatably disposed in the recessed portion 360. A drive shaft 364 extends through the drive screw 362 and beyond one end of the casing 356. An operating handle 366 is disposed at the outer end of the drive shaft 364.

A driven screw 368 extends through the opening 358. An outer diameter of the driven screw 368 is generally equal to an inner diameter of the opening 358. The driven screw 368 engages the drive screw 362 and is movable along an axis of the opening 358. The pitch of the driven screw 368 can be the same as the pitch of the drive screw 362. Together, the drive screw 362 and the driven screw 368 form a worm gear drive. However, other gear drives or actuators can be used.

A push-pull cable 372 is affixed to the driven screw 368 and extends through the opening 350 toward the end of the casing 356 located opposite to the operating handle 366. The push-pull cable 372 further extends beyond the end of the casing 356. A connecting end 374 of the cable 372 is affixed to the free end of the intermediate lever 308 (FIG. 3). The push-pull cable 372 is generally enclosed by a guide cover member 376. One end of the guide cover member 376 extends into the opening 358 and is affixed to an inner wall of the casing 356 that defines the opening 358. Another end of the guide cover member 376 is affixed to a portion of the protective cowling.

As thus constructed the push-pull cable 372 moves back and forth when the handle 366 is rotated by the operator. The intermediate lever 308 thus swings to move the entire throttle valves 84 as described with the auxiliary throttle valve control mechanism 302 of FIG. 3.

The illustrated routine 336 is used to control both the operation related to the secondary air intake device 320 and the operation related to the exchange of the auxiliary controller 264 from the remote controller 246. In one variation, distinctive programs can be used to control these operations separately. Additionally, the auxiliary throttle valve control mechanisms 302, 302A can be omitted in some arrangements.

The remote controller 246 can be connected to the ECU 90 through any electrical devices or members other than the LAN 248. For example, a wire harness can be used for the purpose.

Both the throttle valve position and the shift mode are controlled based upon the communication between the remote controller 246 and the ECU 90 through the LAN 248 as in the illustrated embodiment or through other electrical devices as noted above. However, at least the shift mode can be changed with mechanical linkages that replace the electrical communication devices.

The watercraft propulsion system 30 can have an air intake pressure sensor and/or an air amount sensor additionally to the throttle valve position sensor 218. The intake pressure sensor preferably is disposed at a downstream portion of one throttle valve 84. The respective calculation maps 338, 340, 344, 346 can replace the actual throttle valve position θr with an output of the intake pressure or air amount sensor, and the ECU 90 can controls the fuel injection amount FD and the ignition timing SA using those alternative maps.

Second Embodiment

Figure 13:
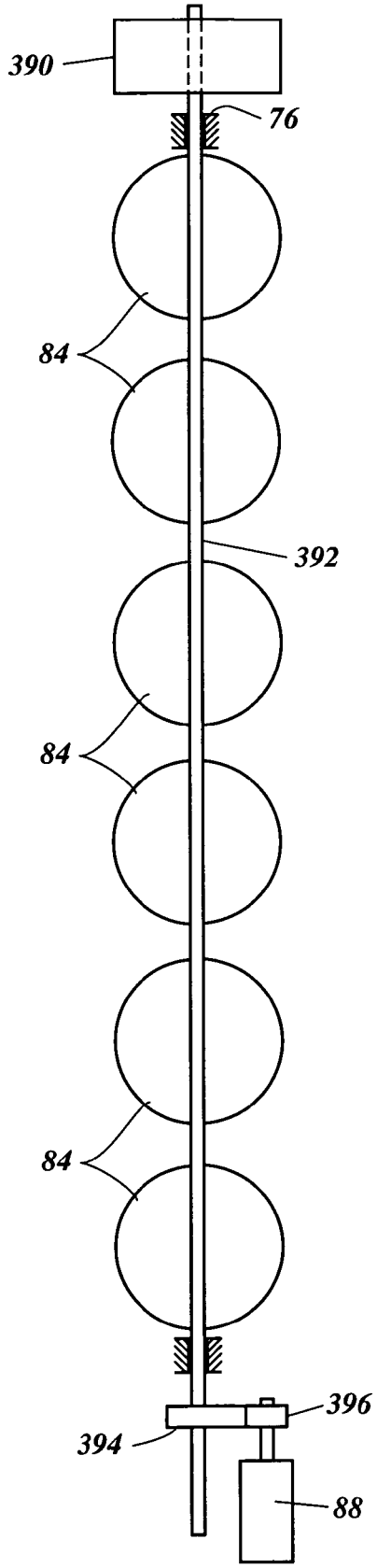
FIG. 13 is a partial schematic view of a modification of the watercraft propulsion system of FIGS. 1–11, with a mechanical neutral position setting mechanism that is coupled with the throttle valves.
Figure 14:
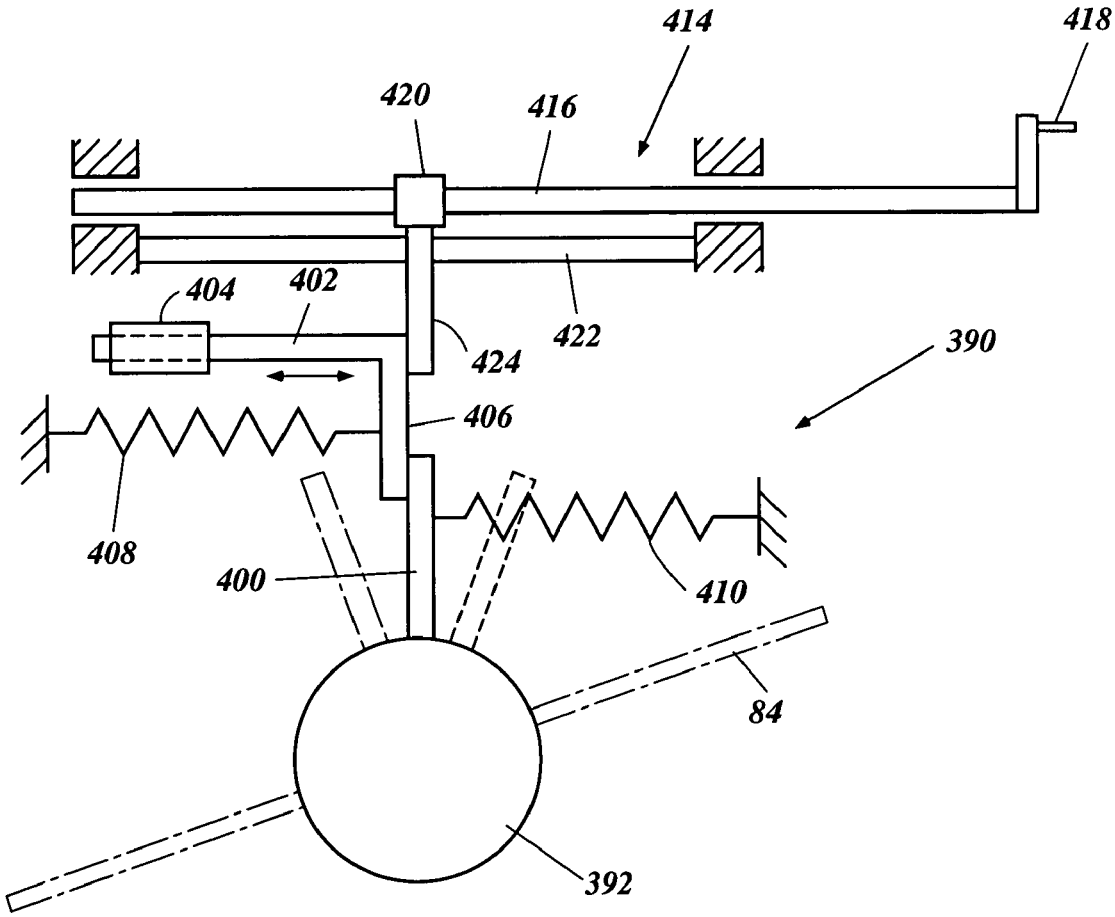
FIG. 14 is a schematic view of the mechanical neutral position setting unit of FIG. 13.
Figure 15:
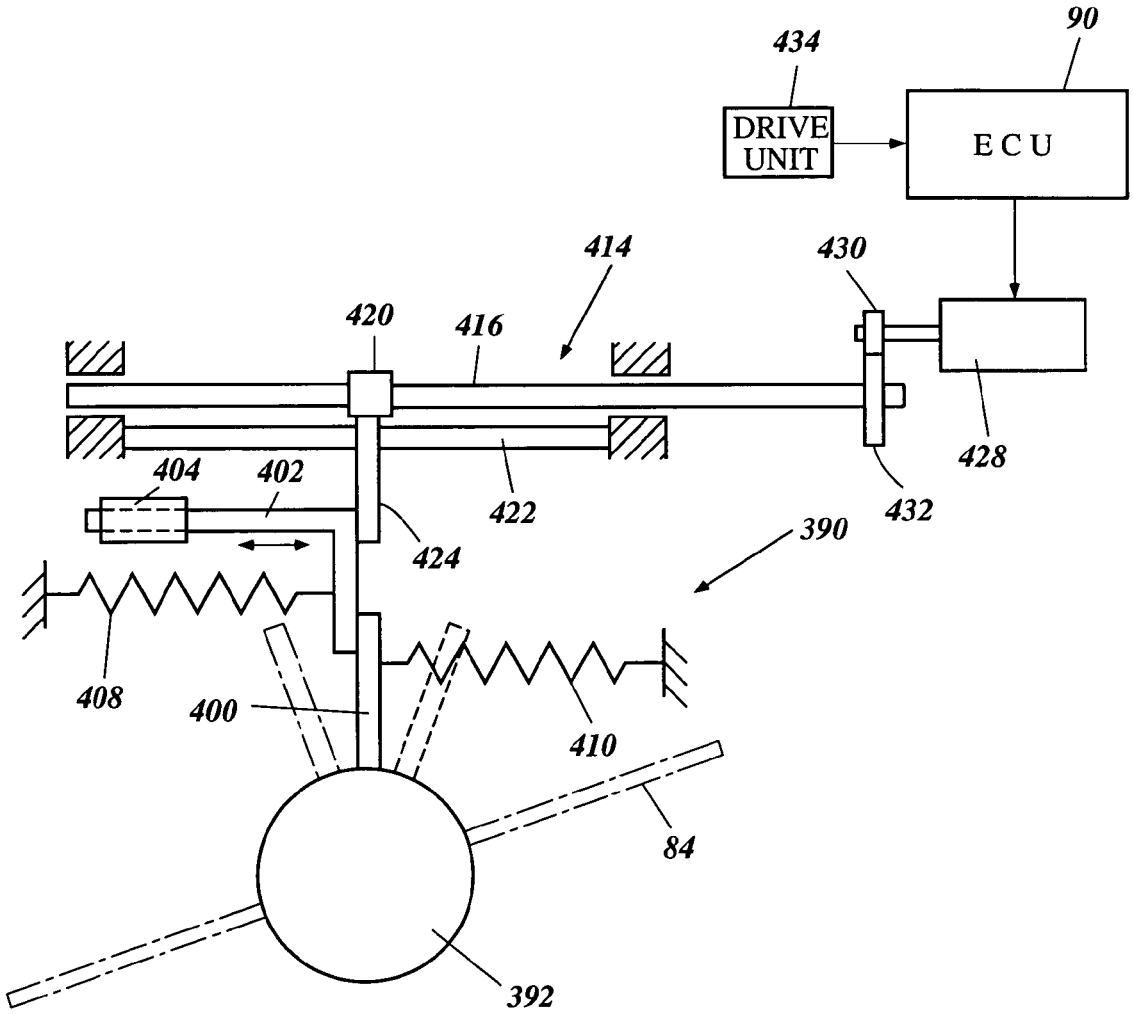
FIG. 15 is a schematic view of a modification of the mechanical neutral position setting unit of FIGS. 3 and 14.

With reference to FIGS. 13–15, a second embodiment is described below. The same devices, components and members or the same commands, amounts, reference values and threshold values as those described above are assigned with the same reference numbers or the same reference characters and are not described repeatedly.

The second embodiment is particularly useful for the watercraft propulsion system 30 on the assumption that the throttle valve actuator or servo motor 88 is unable to move the throttle valves 84 due to some troubles with the servo motor 88 such as, for example, breaking of a wire. If such an abnormal state occurs, the throttle valves 84 are no longer controllable by the throttle valve servomechanism 298.

In this second embodiment, the watercraft propulsion system 30 preferably includes a mechanical neutral position setting unit 390 to automatically move the throttle valves 84 to a mechanical neutral position that is preset.

With reference to FIG. 13, unlike the throttle valves 84 in the first embodiment, the throttle valves 84 in this embodiment are affixed to a common valve shaft 392 that extends generally vertically. The valve shaft 392 is journaled on the throttle body 76. The valve shaft 392 has a driven gear 394 on one side. A drive gear 396 that is affixed to the servo motor 88 meshes the driven gear 394. Under the normal condition, the servo motor 88 drives the valve shaft 392 to move the throttle valves 84 between the closed position and the open position through the drive and driven gears 396, 394 as described in the first embodiment. The mechanical neutral position setting unit 390 is disposed on the opposite side of the valve shaft 392 relative to the driven gear 394.

With reference to FIG. 14, the throttle valves 84 move toward the closed position when the valve shaft 392 rotates clockwise. The valve shaft 392 preferably has an engagement piece 400 at a top outer surface thereof. The engagement piece 400 extends toward the neutral position setting unit 390. A slider 402 is slidably disposed in a guide member 404. The slider 402 is generally configured as an L-shape with a turned portion 406 that generally extends normal to another portion that extends through the guide member 404. An end of the turned portion 406 abuts the engagement piece 400 of the valve shaft 392.

A first compression spring 408, which preferably is a coil spring, is retained on a housing wall of the neutral position setting unit 390 or a support member to urge the engagement piece 400 via the turned portion 406 of the slider 402 such that the throttle valves 84 are biased toward the closed position. A second compression spring 410, which preferably is a coil spring also, is retained on another housing wall of the neutral position setting unit 390 or another support member to directly urge the engagement piece 400 against the turned portion 406. The second compression spring 410 has a spring constant that is smaller than a spring constant of the first compression spring 408. The housing of the neutral position setting unit 390 or the support members preferably mounted on the throttle body 76.

On the other hand, the mechanical neutral position setting unit 390 preferably also includes a neutral position setting section 414. The neutral position setting section 414 comprises a screw shaft 416 that is journaled on the housing of the neutral position setting unit 390. The screw shaft 416 has an inside portion that extends inside of the housing and an outside portion that extends outwardly from the inside portion beyond one wall of the housing. At least, the inside portion of the screw shaft 416 is threaded. The outside portion of the screw shaft 416 has an operating handle 418 with which the operator can rotate the screw shaft 416.

Alternatively, the screw shaft 416 can extend between a pair of support members. One end of the screw shaft 416 can extend beyond one of the support members so as to be out of a space defined by the support members. The space in this alternative corresponds to the inside of the housing.

A nut 420 is movably disposed on the screw shaft 416. A guide bar 422 extends within the housing or between a pair of support members and generally parallel to the inside portion of the screw shaft 416. The guide bar 422 is affixed to inner wall portions of the housing or the support members. A stopper 424 affixed to the nut 420 extends to the turned portion 406 of the slider 402 and abuts the turned portion 406 on a side opposite to the first compression spring 408. Because the nut 420 and the stopper 424 are regulated not to rotate about the screw shaft 416 by the guide bar 422, the nut 420 and the stopper 424 move back and forth on the screw shaft 416 when the operator rotates the operating handle 418. The nut 420 and the stopper 424 stay at any position on the inside portion of the screw shaft 416 unless the operator rotates the handle 416.

If the stopper 424 does not abut the turned portion 406, the slider 402 can slide until the first compression spring 408 extends up to the maximum because the spring constant of the first compression spring 408 is larger than the spring constant of the second compression spring 410. The stopper 424 regulates the slider 402 to stay at a position where the nut 420 is located. The engagement piece 400 and the valve shaft 392 thus can stay at a position where the slider 402 stops. Accordingly, the throttle valves 84 are set at an angular position between the closed and open positions, corresponding to the position of the nut 420.

The throttle valve position set by the mechanical neutral position setting unit 390 is a mechanical neutral position. If the position of the nut 420 is selected properly, the mechanical neutral position gives an initial throttle valve position θrd at which at least the minimum amount of air that maintains the operation of the engine 40 and creates an engine speed for limp home mode operation. The initial position θrd of the throttle valves 84 in the second embodiment thus corresponds to the preset threshold of actual throttle valve position θrp in the first embodiment. Accordingly, the operator preferably selects the position of the nut 420 such that the mechanical neutral position is equal to the initial throttle valve position θrd or greater than the initial throttle valve position θrd.

Under a normal condition of the servo motor 88, initially, the slider 402 abuts the stopper 424, which is located at the position that corresponds to the initial throttle valve position θrd, because the first compression spring 408 urges the turned portion 406 of the slider 402. On the other hand, the engagement piece 400 abuts the turned portion 406 of the slider 402 because the second compression spring 408 urges the engagement piece 400 toward the turned portion 406.

If the control lever 250 of the remote controller 246 is operated to the neutral position N, the servo motor 88 rotates the valve shaft 392 clockwise, as viewed in FIG. 14, so that the throttle valves 84 move toward the closed position because the throttle valve position command θt is "0." The throttle valves 84 move to the closed position with the engagement piece 400 moving against the bias force of the second compression spring 410.

In this state, if the control lever 250 is operated to a certain position within the acceleration range E to provide the throttle valve position command θt, the servo motor 88 rotates the valve shaft 392 in an counter-clockwise direction in accordance with the throttle valve position command θt. The throttle valves 84 thus move toward the open position that corresponds to the throttle valve position command θt. If the throttle valve position corresponding to the throttle valve position command θt exceeds the mechanical neutral position, upon abutting the turned portion 406 of the slider 402, the engagement piece 400 pushes the slider 402 against the bias force of the first compression spring 408. Accordingly, the throttle valves 84 reach the target throttle valve position corresponding to the throttle valve position command θt.

As thus described, the throttle valves 84 can move to any position between the closed and open positions without being disturbed by the first or second compression spring 408, 410 under the normal condition.

In the event such that an abnormal state occurs at the servo motor 88, the throttle valves 84 automatically return to the mechanical neutral position as follows due to the malfunction of the servo motor 88.

If the throttle valves 84 are previously controlled to be at an actual position θr that is closer to the open position than the initial position θrd (e.g., the one dot chain line of FIG. 14 shows the engagement piece 400 positioned at a position corresponding to the throttle valves in this state), the throttle valves 84 are urged toward the closed position by the bias force of the first compression spring 408 via the slider 402. The throttle valves 84, however, stop at the initial position θrd because the slider 402 is stopped by the stopper 424. The engine 40 thus can be supplied with the air amount corresponding to the initial position θrd of the throttle valves 84 that ensures the watercraft 37 can operate under a satisfactory limp home speed.

If the throttle valves 84 are previously controlled to be at an actual position θr closer to the closed position than the initial position θrd (e.g., the dotted line of FIG. 14 shows the engagement piece 400 positioned at a position corresponding to the throttle valves in this state), the throttle valves 84 are urged toward a more open position by the bias force of the second compression spring 410. The throttle valves 84, however, stop at the initial position θrd because the engagement piece 400 is stopped by the slider 402 because the spring constant of the first compression spring 408 is larger than the spring constant of the second compression spring 410. The engine 40 thus can be supplied with the air amount corresponding to the initial position θrd of the throttle valves 84 that ensures the watercraft 37 can operate at a satisfactory limp home speed.

When docking, a watercraft, such as the watercraft 37, needs to approach a place where the watercraft 37 can be berthed or removed from the water. Such areas, e.g., harbors, usually have low speed limits in a trolling speed range, such as 5 miles per hour. For example, such a trolling speed can correspond to an engine speed approximately 1,500 rpm or less. However, the engine speed corresponding to the initial position θrd of the throttle valves 84 can be higher than the trolling speed.

The operator thus rotates the operating handle 418 to move the nut 420 toward a right hand direction in the view of FIG. 14. The slider 402 thus slides in the same direction to allow the throttle valves 84 to move toward the closed position. The engine speed is now set at the trolling speed, accordingly.

During a docking maneuver, an operator might turn the watercraft 37 to direct the stern thereof toward the berthing place by the steering mechanism and move the control lever 250 of the remote controller 246 toward the reverse troll position R. The shift rod actuator 212 actuates the dog clutch unit 206 to engage the reverse bevel gear 202. The propeller 56 thus is set in the reverse mode. Accordingly, the watercraft 37 proceeds backwardly in the trolling speed toward the berthing place.

As thus described, the operator can select the mechanical neutral position at any position. If the operator desires a higher engine speed, the operator can operate the handle 418 to move the nut 420 and the stopper 424 toward the left-hand direction in the view of FIG. 14. On the other hand, if the operator desires a lower engine speed, the operator can operate the handle 418 to move the nut 420 and the stopper 424 toward the right-hand direction in the view of FIG. 14.

The mechanical neutral position setting unit 390 can have various configurations. FIG. 15 illustrates one variation, for example, in which the screw shaft 416 is rotated by an electrically operated mechanism rather than being manually rotated. Another servo motor 428 replaces the operating handle 418 in this variation. The servo motor 428 is coupled with the screw shaft 416 through a drive gear 430 and a driven gear 432. The ECU 90 controls the servo motor 428. A drive unit 434, which preferably is a switch assembly, is connected to the ECU 90 to provide control commands that indicate right or reverse directional rotation of the servo motor 428. Thus, the servo motor 428 move the nut 420 and the stopper 424 toward any position under control of the ECU 90 in accordance with the control commands provided by the drive unit 434.

In another variation, the second compression spring 410 can be located at a bottom portion of the valve shaft 392. A coil spring or coil springs turned around the valve shaft 392 can replace the first and second compression springs 408, 410. The slider 402 can be modified into a rotating ring that has a center axis that is the same as a center axis of the valve shaft 392. Other conventional linear drive mechanism can replace the neutral position setting section 414.

Also, each throttle valve 84 can be individually provided with the mechanical neutral position setting unit 390 if the throttle valves 84 are not coupled together by such a common valve shaft 392 and individually has separate valve shafts.

Figure 16:
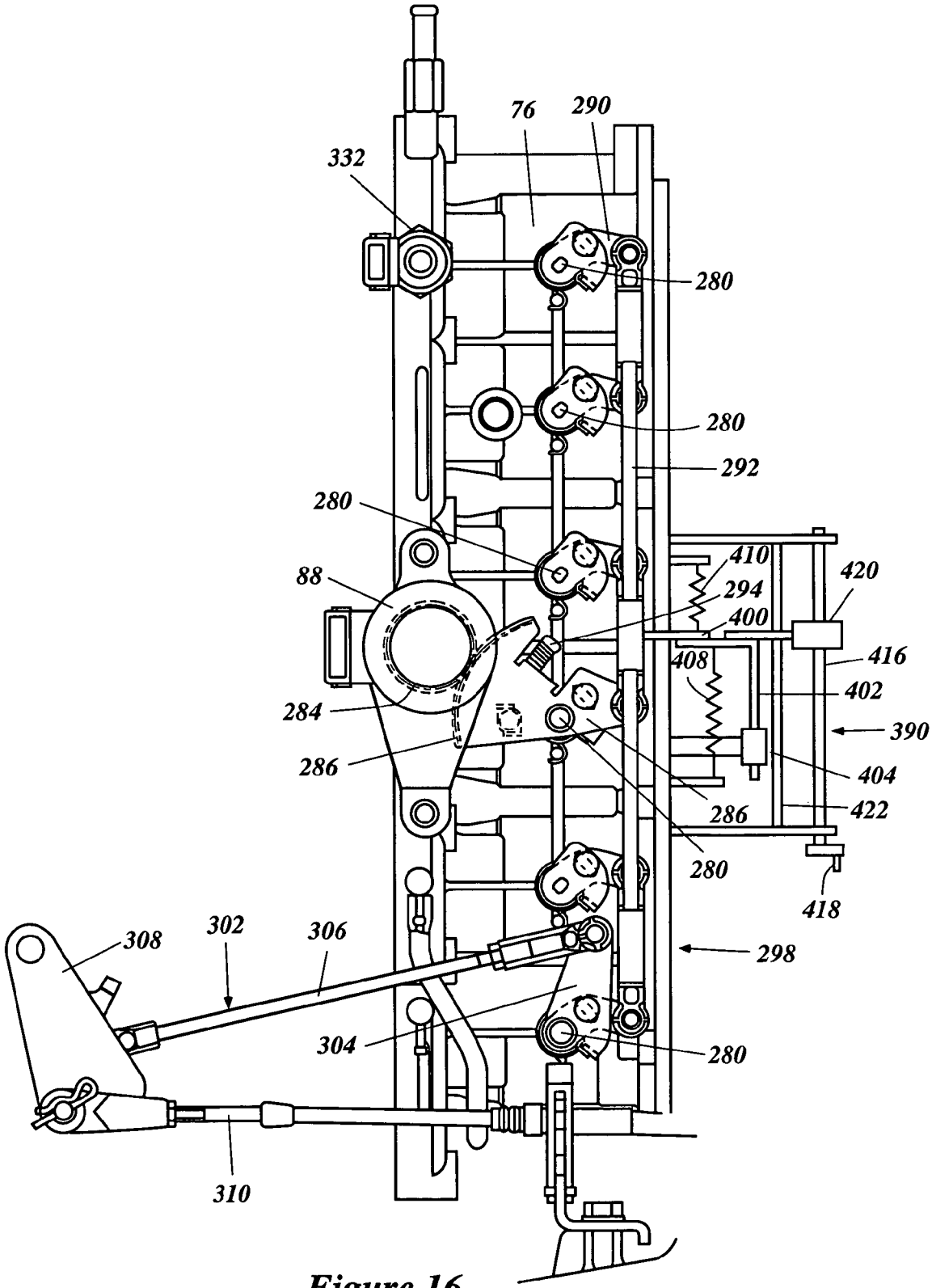
FIG. 16 is a side elevational view of a throttle body on which another modification of the mechanical neutral position setting unit is mounted.

Further, the throttle valve servomechanism 298 of the first embodiment can have the mechanical neutral position setting unit 390. FIG. 16 illustrates this variation.

The engagement piece 400 in this variation extends from the linkage rod 292. Alternatively, the engagement piece 400 can extend from one of the levers 290 or each one of the levers 290. Additionally, FIG. 16 illustrates that support members retain the springs 408, 410 and support the screw shaft 416 and the guide bar 422.

Third Embodiment

Figure 17:
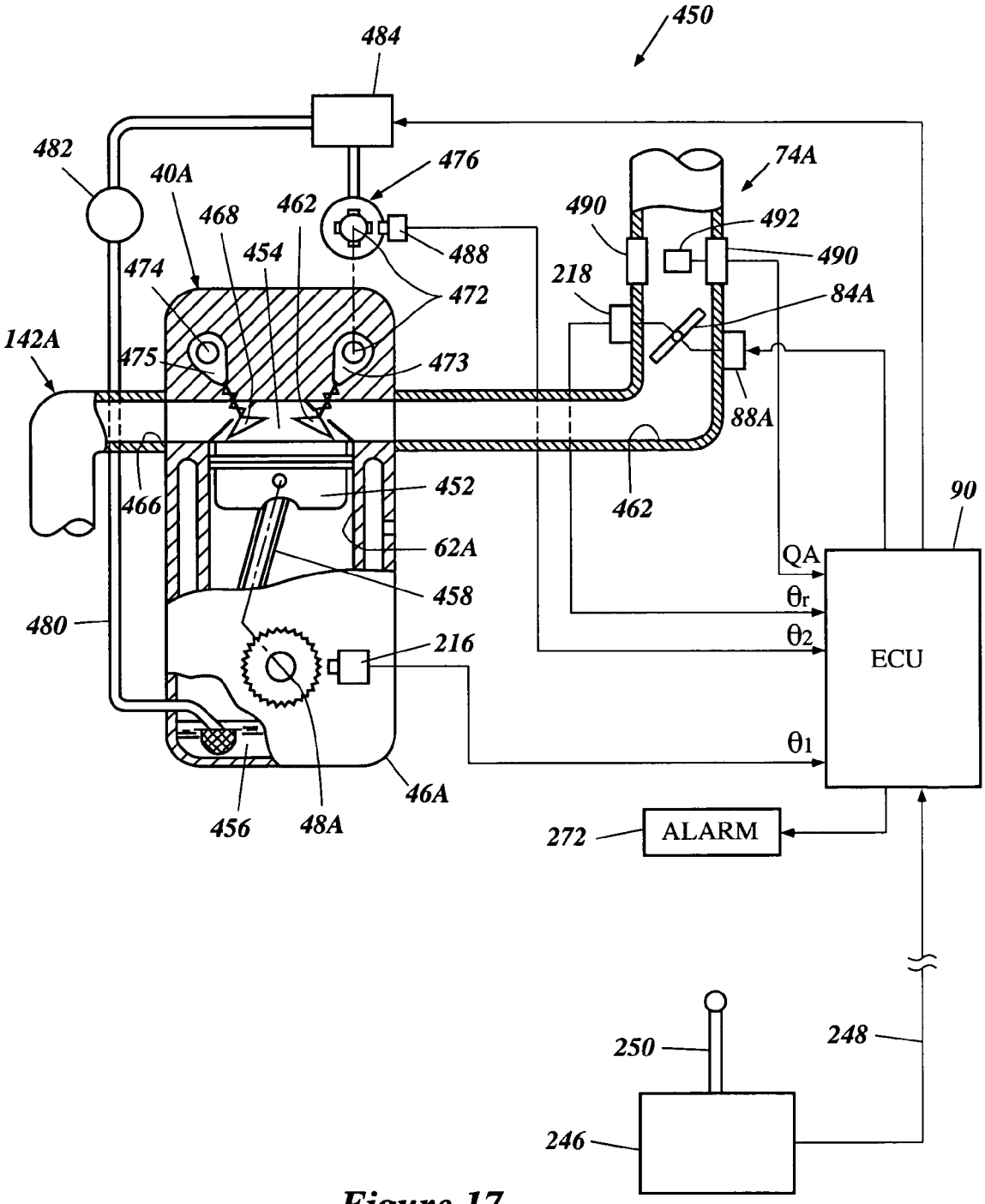
FIG. 17 is a schematic multi-part view of another modification of the watercraft propulsion system of FIGS. 1–11, wherein an engine that has a variable valve timing mechanism is shown.
Figure 18:
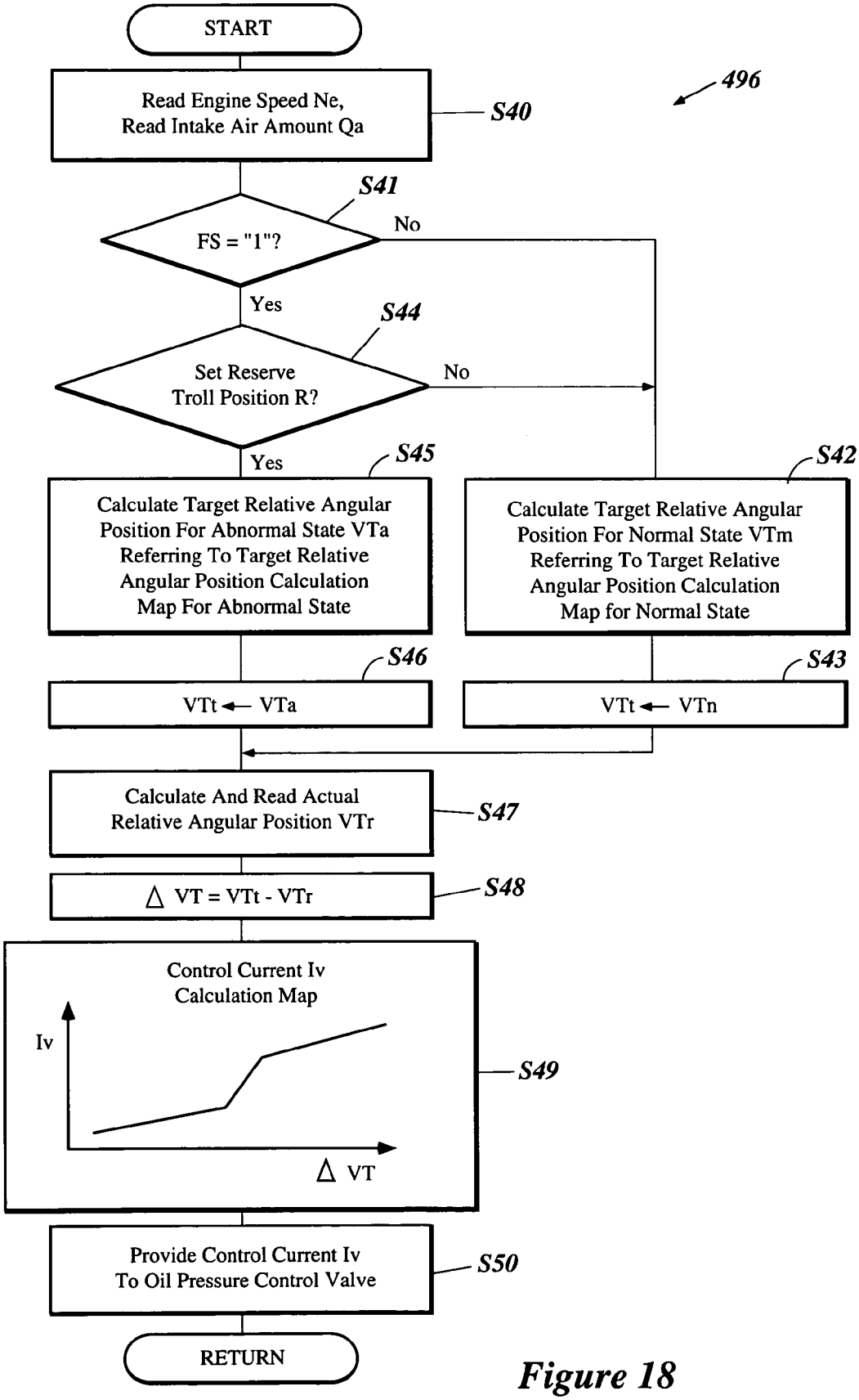
FIG. 18 is a flow chart that shows a control routine that can be used to operate the watercraft propulsion system of FIG. 17 that controls the variable valve timing mechanism of FIG. 17.
Figure 19:
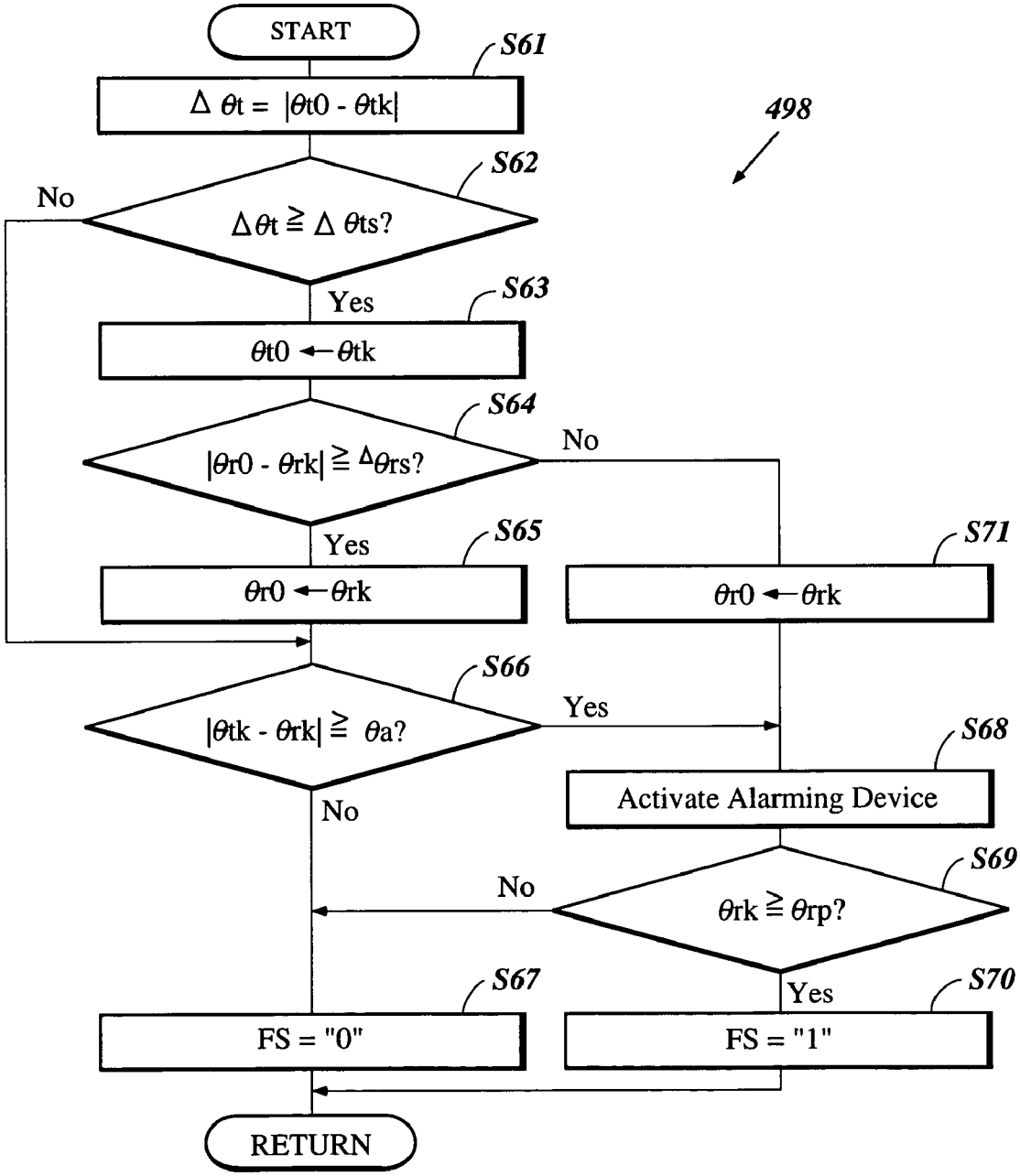
FIG. 19 is a flow chart that shows a control routine that can be used to set a throttle valve state flag FS that is used in the flow chart of FIG. 18.

With reference to FIGS. 17–19, a third embodiment is described below. The same devices, components and members or the same commands, amounts, reference values and threshold values as those described above are assigned with the same reference numbers or the same reference characters and are not described repeatedly.

The third embodiment enables further enhances the procedure for berthing or docking of the watercraft 37 during a limp home more operation. This embodiment is particularly useful when the large opening degree side binding phenomenon has occurred. For example, the ECU 90 can control an engine to slow down the engine speed when the ECU 90 determines that such an abnormal state occurs and the watercraft 37 is berthing.

FIG. 17 schematically illustrates an engine 40A, an air intake device 74A and an exhaust device 142A of the watercraft propulsion system 450 in the third embodiment. The engine 40A in this embodiment operates on a four-stroke combustion principle and employs a double overhead cam system. The four-stroke engine 40A and related components thereof have similar constructions to the two-stroke engine and the related components thereof, respectively, those are described above. Thus, the four-stroke engine 40A and the related components in this embodiment are conveniently indicated by the reference numerals that has the letter "A" if correspond to those of the two-stroke engine and the components described above. Differences between the four-stroke engine 40A and the two-stroke engine are obvious to those of ordinary skill in the art.

An engine body 46A defines at least one cylinder bore 62A in which a piston 452 reciprocates. The engine body 46A together with the piston 452 defines a combustion chamber 454 at one end of the cylinder bore 62A. The engine body 46A also defines a crankcase chamber 456 at another end of the cylinder bore 62A. A crankshaft 48A is journaled on the engine body 46A on this side and is connected with the piston 452 by a connecting rod 458. The crankshaft 48A rotates when the piston 452 reciprocates within the cylinder bore 62A.

The engine 40A preferably has a dry sump lubrication system. The illustrated crankcase chamber 456 keeps a certain amount of lubricant oil for the lubrication system. Other tanks or reservoirs are of course applicable to keep the lubricant oil.

The air intake device 74A is connected to the engine body 46A such that an air intake passage 462 communicates the combustion chamber 454. At least one air intake valve 462 is slidably disposed at an air intake port of the combustion chamber 454. The intake valve 462 can be moved between an open position and a closed position. The intake valve 462 is normally placed at the closed position by a bias spring. The intake passage 462 is disconnected from the combustion chamber 454 when the intake valve 462 is placed at the closed position, while the intake passage 462 is connected to the combustion chamber 454 when the intake valve 462 is placed at the open position. The intake device 74A has the throttle valve 84A upstream of the intake valve 462 within the intake passage 462.

The exhaust device 142A is connected to the engine body 46A such that an exhaust passage 466 communicates with the combustion chamber 454. At least one exhaust valve 468 is slidably disposed at an exhaust port of the combustion chamber 454. The exhaust valve 468 can be moved between an open position and a closed position. The exhaust valve 468 is normally placed at the closed position by a bias spring. The exhaust passage 466 is disconnected from the combustion chamber 454 when the exhaust valve 468 is placed at the closed position, while the exhaust passage 466 is connected to the combustion chamber 454 when the exhaust valve 468 is placed at the open position.

An intake camshaft 472 actuates the intake valve 462 with an intake cam 473. The intake camshaft 472 is journaled on the engine body 46A generally above the intake valve 462. An exhaust camshaft 474 actuates the exhaust valve 468 with an exhaust cam 475. The exhaust camshaft 474 also is journaled on the engine body 46A and generally above the exhaust valve 468. Basically, the crankshaft 48A drives the intake and exhaust camshafts 472, 474 in keeping proper timed relationships.

The engine 40A preferably has a hydraulically operated variable valve timing control mechanism 476, which is illustrated as being coupled with the intake camshaft 472 in FIG. 17. The control mechanism 476, however, can be coupled with the exhaust camshaft 474 or both the intake and exhaust camshafts 472, 474.

The illustrated variable valve timing control mechanism 476 adjusts opening and closing timings of the intake valve 462 by hydraulically rotating the intake camshaft about an axis of the intake camshaft 472. The variable valve timing control mechanism 476 preferably uses a portion of the lubricant oil in the crankcase chamber 456. In one variation, the variable valve timing control mechanism 476 can use lubricant oil in a tank or reservoir other than the crankcase chamber 456. Further, in another variation, the variable valve timing control mechanism 476 can have an oil reservoir for its own use.

The variable valve timing control mechanism 476 preferably comprises an oil delivery passage 480 through which the lubricant oil is delivered to the variable valve timing control mechanism 476 from the crankcase chamber 456. An oil pump 482 is disposed in the oil delivery passage 480 to pressurize the oil toward the control mechanism 476. An oil pressure control valve 484 is disposed between the oil pump 482 and the control mechanism 476 in the oil delivery passage 480. The oil pressure control valve 484 is an electrically operated valve such as, for example, a servo motor actuated valve, and controls an oil pressure that is delivered to the control mechanism 476 based upon an electric current Iv that is input by the ECU 90. The variable valve timing control mechanism 476 brings the intake camshaft 472 to a target relative angular position VTt, which is given relative to an angular position of the crankshaft 48, in response to the oil pressure.

In general, the engine speed can be changed in accordance with the relative angular position. That is, if the relative angular position is an advanced position, the opening and closing timing of the intake valve 462 is advanced than a reference timing. If, on the other hand, the relative angular position is a delayed position, the opening and closing timing of the intake valve 462 is delayed relative to the reference timing. If the relative angular position is an excessively advanced or delayed position, the engine speed slows down. In the third embodiment, the engine speed needs to slow down so that the dog clutch unit 206 readily engages the reverse bevel gear 202. The engine speed preferably is, for example, approximately 1,500 rpm or less.

The ECU 90 in this embodiment can use information about the state of the engine operation and the operator's desire to control the oil pressure control valve 484. The crankshaft angular position sensor 216 is located adjacent to the crankshaft 48A to provide a crankshaft angular position θ1 to the ECU 90. A cam angular position sensor 488 is located adjacent to the intake camshaft 472 to provide a cam angular position θ2 to the ECU 90. The throttle valve position sensor 218 is located at the valve shaft of the throttle valve 84A to provide an actual valve position θr to the ECU 90. An air amount sensor 490 is located upstream of the throttle valve 84A to provide an intake air amount QA to the ECU 90. The air amount sensor 490 preferably is an air flow meter that has an air flow detecting element 492 such as, for example, a moving vane or a heat wire disposed in the intake passage 462. The remote controller 246 that has the control lever 250 also is connected to the ECU 90 through the LAN 248 to provide the operator's desire.

The foregoing abnormal conditions such as the small opening degree side or large opening degree side binding phenomenon can occur also in this embodiment. The alarming device 272 is provided to be activated under control of the ECU 90. Additionally, the throttle valve 84A is actuated by the servo motor 88A.

In one variation, the intake device 74A can additionally have an air intake pressure sensor at a location downstream of the throttle valve 84A.

With reference to FIG. 18, a control routine 496 that is used for control of the watercraft propulsion system 30 in the third embodiment is described below. The control routine 336 is stored in the memory or other storage device of the ECU 90.

Preferably, the ECU 90 changes the current Iv using the control routine 496 to bring the angular position of the intake camshaft 472 such that the engine speed decreases when the ECU 90 determines that the abnormal state occurs at the throttle valve 84A and the operator operates the control lever 250 to the reverse troll position R. The oil pressure control valve 484 supplies a certain amount of oil to the valve timing control mechanism 476 in response to the current Iv.

In operation, the routine 496 starts and proceeds to a step S40. The ECU 90, at the step S40, calculates an engine speed Ne based upon the crankshaft angular position sensed by the crankshaft angular position sensor 216. The ECU 90 also reads an air amount QA sensed by the air amount sensor 490 at the step S40. The routine 496 then goes to a step S41.

At the step S41, the ECU 90 determines whether a throttle valve state flag FS is set to "1." The throttle valve state flag FS represents the throttle valve 84A in a normal state "0" or in an abnormal state "1". The throttle valve state flag FS can be set in accordance with another control routine 498 illustrated in FIG. 19, described below. If the determination at the step S41 is negative, i.e., the flag FS is reset to "0," the ECU 90 recognizes that the throttle valve 84 is not in an abnormal state, i.e., the throttle valve 84A works normally. The routine 496 goes to a step S42.

The ECU 90, at the step S42, calculates a target relative angular position for normal state VTn of the oil pressure control valve 484 using a target relative angular position calculation map for normal state (not shown). The target relative angular position state calculation map for normal is stored in the memory or other storage device of the ECU 90. The target relative angular position calculation map for normal state can be a two parameter map in which one specific target relative angular position for normal state VTn is determined based upon two parameters which are the engine speed Ne and the air amounts QA. The routine 496 then goes to a step S43.

In one variation, the target relative angular position calculation map for normal state can have actual throttle valve position θr or intake pressures instead of the air amounts QA. The ECU 90 can read the throttle valve position θr or intake pressure rather than the air amount QA in this variation.

At the step S43, the ECU 90 sets the target relative angular position for normal state VTn calculated at the step S42 as a target relative angular position VTt and stores the target relative angular position for normal state VTn as the target relative angular position VTt into a storage area of the target relative angular position in the storage or replaces a target relative angular position VTt previously stored if this practice is a second or later practice. The routine 496 then proceeds to a step S47.

On the other hand, if the determination at the step S41 is positive, i.e., the flag FS is set to "1," the ECU 90 recognizes that the throttle valve 84 is in some abnormal state, i.e., the throttle valve 84 does not work normally. The routine 496 then goes to a step S44.

At the step S44, the ECU 90 determines whether the control lever 250 of the remote controller 246 is set to the reverse troll position R. As described above, the operator normally sets the control lever 250 to this position R when the watercraft 37 is berthing after turning the watercraft 37 to direct the stem of the watercraft 37 to a berthing location. If the determination at the step S44 is negative, the ECU 90 recognizes that the watercraft 37 is not berthing and the routine 496 goes to the step S42 to conduct the step S42. If the determination at the step S44 is positive, the ECU 90 recognizes that the watercraft 37 is berthing and the routine 496 goes to a step S45.

The ECU 90, at the step S45, calculates a target relative angular position for abnormal state VTa of the oil pressure control valve 484 using a target relative angular position calculation map for abnormal state (not shown). The target relative angular position for abnormal state VTa preferably corresponds to the engine speed that is sufficiently slow enough for the dog clutch unit 206 to readily engage the reverse bevel gear 202. As noted above, such an engine speed is, for example, approximately 1,500 rpm or less.

The target relative angular position calculation map for abnormal state is stored in the storage of the ECU 90. The target relative angular position calculation map for abnormal state is a two parameter map in which one specific target relative angular position for abnormal state VTa is determined based upon two parameters which are the engine speed Ne and the air amount QA. The routine 496 then goes to a step S46.

Like the target relative angular position for normal state calculation map, the target relative angular position calculation map for abnormal state can have actual throttle valve positions θr or intake pressures instead of the air amounts QA. The ECU 90 can read the throttle valve position θr or intake pressure rather than the air amount QA in this variation as well.

At the step S46, the ECU 90 sets the target relative angular position for abnormal state VTa calculated at the step S45 as a target relative angular position VTt and stores the abnormal target relative angular position VTa as the target relative angular position VTt into the storage area of the target relative angular position in the storage or replaces a target relative angular position VTt previously stored if this practice is a second or later practice. The routine 496 then proceeds to the step S47.

The ECU 90, at the step S47, calculates an actual relative angular position VTr based upon the current cam angular position θ2 sensed by the cam angular position sensor 488 and the current crankshaft angular position θ1 sensed by the crankshaft angular position sensor 216. That is, the actual relative angular position VTr is a difference between the cam angular position θ2 and the crankshaft angular position θ1. The routine 496 then goes to a step S48.

At the step S48, the ECU 90 calculates a relative angular difference ΔVT by subtracting the actual relative angular position VTr from the target relative angular position VTt stored in the storage area of the target relative angular position in the storage. The routine 496 then proceeds to a step S49.

The ECU 90, at the step S49, calculates the control current Iv using a control current calculation map that is illustrated in FIG. 18. The control current calculation map is stored in the storage of the ECU 90. The control current calculation map is a one parameter map in which one specific control current Iv is determined based upon one parameter that is the relative angular difference ΔVT. Then, the routine 496 goes to a step S50.

At the step S50, the ECU 90 provides the oil pressure control valve 484 with the control current Iv determined at the step S49. The control valve 484 thus moves to open the oil delivery passage 480 in response to the control current Iv. A certain amount of the oil that is determined by the position of the control valve 484 is allowed to flow to the valve timing control mechanism 476. The control mechanism 476 actuates the intake camshaft 472 to change the angular position of the intake camshaft 472. Eventually, the engine 40A operates at an engine speed corresponding to the control current Iv provided to the oil pressure control valve 484. The routine 496 then returns back to the step S40 to repeat the step S40.

With reference to FIG. 9, the control routine 498 to set the throttle valve state flag FS is described below.

In the first embodiment using the control routine 336 of FIG. 6, the large opening degree side binding phenomenon determined at the step S16 does not cause any problem in limping home because a satisfactory amount of air is ensured. In this embodiment, however, the large opening degree side binding phenomenon hinders the watercraft 37 when an operator attempts low speed maneuvers, such as berthing. The small opening degree side binding phenomenon is not likely to cause such problems.

The control routine 498 thus runs to determine whether the large opening degree side binding phenomenon occurs and sets the throttle valve state flag FS to "1" if this phenomenon occurs.

The routine 498 starts and proceeds to a step S61. The ECU 90, at the step S61, calculates the change amount of command Δθt that represents the amount of the current throttle valve position command θtk changed from the reference throttle valve position command θt0 by taking an absolute value of difference between the throttle valve position command reference θt0 and the current throttle valve position command θtk. The routine 498 then goes to a step S62.

The ECU 90, at the step S62, determines whether the change amount of command Δθt is equal to or greater than the preset threshold of change amount of command Δθts. If the determination is positive, the ECU 90 recognizes that the throttle valve position command θt has been changed and the routine 498 goes to a step S63.

At the step S63, the ECU 90 sets the current throttle valve position command θtk as the throttle valve position command reference θt0 at this moment and stores the current throttle valve position command θtk as the throttle valve position command reference θt0 to the storage area of the throttle valve position command reference in the storage. Then, the routine 498 proceeds to a step S64.

The ECU 90, at the step S64, calculates an absolute value of difference between the actual throttle valve position reference θr0 and the current actual throttle valve position θrk and determines whether the absolute value of difference is equal to or greater than the preset threshold of actual change amount Δθrs. If the determination is positive, the ECU 90 assumes that the actual throttle valve position is normally changed. However, it is possible that the throttle valve is not properly following the throttle valve position command θt. The routine 336 goes to a step S65.

At the step S65, the ECU 90 sets the current actual throttle valve position θrk as an actual throttle valve position reference θr0 at this moment and stores the current actual throttle valve position θrk as an actual throttle valve position reference θr0 into the memory area for the current actual throttle valve position. Then, the program proceeds to a step S66.

The ECU 90, at the step S66, calculates an absolute value of difference between the current throttle valve position command θtk and the current actual throttle valve position θrk, and determines whether the absolute value of difference is equal to or greater than the threshold of abnormal state θa that separates the abnormal state from the normal state. If the determination at the step S66 is negative, the ECU 90 recognizes that the actual throttle valve position θr is properly following the throttle valve position command θt or a deviation of the actual throttle valve position θr from the throttle valve position command θt is small enough to be neglected. The routine 498 goes to a step S67.

At the step S67, the ECU 90 resets the throttle valve state flag FS to "0." The routine 498 then returns back to the step S61 to repeat the step S61.

If the determination at the step S66 is positive, the ECU 90 recognizes that some abnormal state occurs, and the routine 498 goes to a step S68.

The ECU 90, at the step S68, operates the alarming device 272 to sound and/or indicate that the abnormal state such as the binding phenomenon occurs. Then, the routine 498 goes to a step S69.

At the step S69, the ECU 90 determines whether the current actual throttle valve position θrk is equal to or greater than the preset throttle valve position θrp. The preset throttle valve position θrp in this embodiment is a threshold throttle valve position to determine whether the large opening degree side binding phenomenon occurs. If the determination at the step S69 is positive, the ECU 90 recognizes that the large opening degree side binding phenomenon occurs, and the routine 498 goes to a step S70.

The ECU 90, at the step S70, sets the throttle valve state flag FS to "1." The routine 498 then returns back to the step S61 to repeat the step S6.

If the determination at the step S69 is negative, the ECU 90 recognizes that the large opening degree side binding phenomenon is not occurring. The routine 498 goes to the step S67 to conduct the step S67.

On the other hand, if the determination at the step S64 is negative, the ECU 90 recognizes that some abnormal state such as the large or small opening degree side binding phenomenon occurs because the throttle valve position θr does not follow the throttle valve position command θt properly. The routine 498 then goes to the step S71.

At the step S71, the ECU 90 sets the current actual throttle valve position θrk as an actual throttle valve position reference θr0 at this moment and stores the current actual throttle valve position θrk as an actual throttle valve position reference θr0 into the area of the current actual throttle valve position in the storage. The operation at the step S71 is the same as the operation at the step S65. After conducting the step S71, the program proceeds to the step S68 such that the ECU 90 operates the alarming device 272.

Also, if the determination at the step S62 is negative, the routine 498 goes to the step S66 to conduct the step S66.

With reference back to FIG. 18, if the abnormal state does not occur or the small opening degree side binding phenomenon occurs, the throttle valve state flag FS is reset to "0" at the step S41 of the routine 496 as a result of the operation of the routine 498 of FIG. 9. The ECU 90 conducts the steps S42, S43, S47, S48, S49 and S50 of the routine 496. That is, the ECU 90 conducts the normal valve timing control using the variable valve timing control mechanism 476. The engine speed of the engine 40 thus normally increases or decreases.

If the large opening degree side binding phenomenon occurs, the throttle valve state flag FS is set to "1" at the step S41 of the routine 496 as a result of the operation of the routine 498 of FIG. 9. The ECU 90 thus conducts the step S44. If the control lever 250 of the remote controller 246 is set at a position within the acceleration range E, the watercraft 37 operates in a limp home mode. The air amount is sufficient because the current throttle valve position θrk is equal to or larger than the preset threshold of actual throttle valve position θrp. The ECU 90 thus conducts the steps S42, S43, S47, S48, S49 and S50 afterwards.

The operator can operate the control lever 250 to the reverse troll position R when the watercraft 37 is ready to berth after limping home. The determination at the step S44 now is positive. The ECU 90 thus conducts the steps S45, S46, S47, S48, S49 and S50 to slow down the engine speed for the berthing of the watercraft 37.

In the third embodiment, the ECU 90 uses the preset threshold of actual throttle valve position θrp that is the same as the preset threshold of actual throttle valve position θrp used in the first embodiment. In one variation, the ECU 90 can use another preset throttle valve positions. This other preset throttle valve position preferably is more suitable to determine the large opening degree side binding phenomenon.

The engine speed can be slowed down in other methods under the situation that the throttle valve state flag FS is set to "1" and the control lever 250 of the remote controller 246 is set to the reverse troll position R. In one alternative, the ECU 90 can control the ignition timing to slow down the engine speed using a control routine 502 illustrated in FIG. 20.

Figure 20:
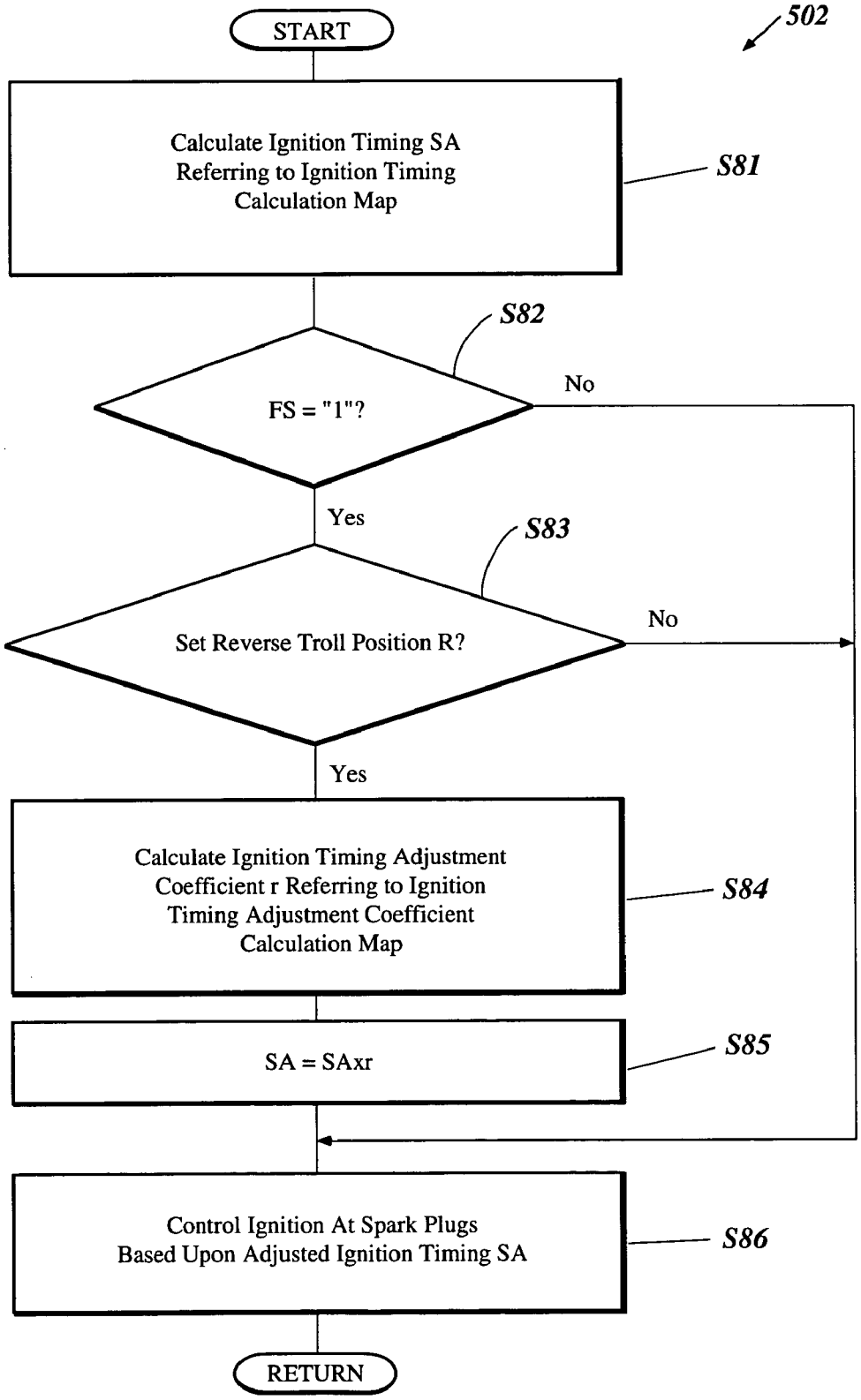
FIG. 20 is a flow chart that shows another control routine that can be used to operate the watercraft propulsion system of FIG. 17, wherein the alternative operation controls an ignition timing of an engine.

With reference to FIG. 20, the control routine 502 is configured to reduce engine speed through ignition timing manipulation. The same devices, components and members or the same commands, amounts, reference values and threshold values as those described above are assigned with the same reference numbers or the same reference characters and are not described repeatedly. The routine 502 can be stored in the memory or other storage device of the ECU 90.

In operation, the routine 502 starts and proceeds to a step S81. The ECU 90, at the step S81, calculates an ignition timing SA based upon, for example, an engine speed Ne and a throttle valve position θr using, for example, the ignition timing calculation map 340 of FIG. 8. The ECU 90 stores the ignition timing SA in the storage area of the ignition timing in the storage. The routine 502 then goes to a step S82.

At the step S82, the ECU 90 determines whether the throttle valve state flag FS is set to "1." If the determination at the step S82 is negative, i.e., the flag FS is reset to "0," the ECU 90 recognizes that the throttle valve 84 is not in an abnormal state. The routine 502 goes to a step S83.

The ECU 90, at the step S83, controls the spark plugs 140 based upon the ignition timing SA calculated at the step S81. The routine 502 returns back to the step S81 to repeat the step S81.

If the determination at the step S82 is positive, i.e., the throttle valve state flag FS is set to "1," the routine 502 proceeds to a step S84.

At the step S84, the ECU 90 determines whether the control lever 250 of the remote controller 246 is set to the reverse troll position R. If the determination at the step S84 is negative, the ECU 90 recognizes that the watercraft 37 is not berthing and the routine 502 goes to the step S83 to conduct the step S83. If the determination at the step S84 is positive, the ECU 90 recognizes that the watercraft 37 is berthing and the routine 502 goes to a step S85.

The ECU 90, at the step S85, calculates an ignition timing adjustment coefficient γ (γ<1) that can be used to calculate an adjusted ignition timing SA by referring to an ignition timing adjustment coefficient calculation map, which is stored in the storage area of the ECU 90. The ignition timing adjustment coefficient γ is used to delay the ignition timing SA, wherein thereby reduced the output of the engine 40. Then, the routine 502 goes to a step S86.

The ECU 90, at the step S86, calculates the adjusted ignition timing SA by multiplying the initial or previous ignition timing SA by the ignition timing adjustment coefficient γ. The adjusted ignition timing SA is stored in the storage area of the ignition timing in the storage. Then, the routine 502 goes to the step S83 to conduit the step S83 with the adjusted ignition timing.

In another alternative, the ECU 90 can disable one or more cylinders based upon the actual throttle valve position θr to slow down the engine speed if the engine has multiple cylinders. The disabling of the cylinders can be practiced by, for example, stopping fuel supply to those cylinders.

Figure 21:
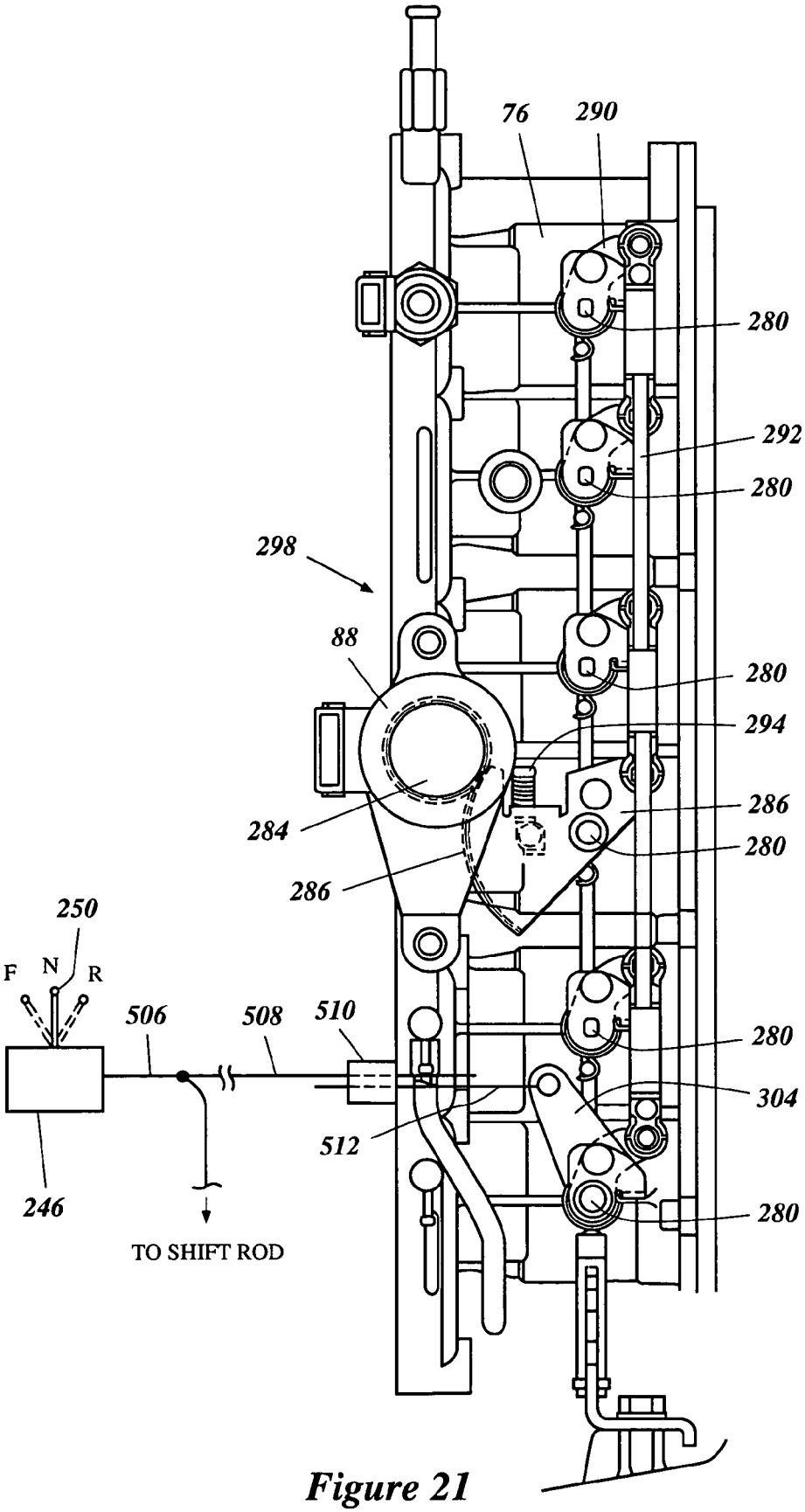
FIG. 21 is a side elevational and partial schematic view of a throttle valve linkage and remote controller that can be used with the watercraft propulsion system of FIG. 17.

In a further alternative, the engine 40 can slow down the engine speed under the abnormal condition with the throttle valve(s) 84 mechanically connected to the remote controller 246. FIG. 21 illustrates one exemplary construction of this mechanical linkage between the throttle valves 84 and the remote controller 246. The same devices, components and members as those described above are assigned with the same reference numbers and are not described repeatedly.

The remote controller 246 in this alternative is mechanically connected to the shift rod 208 through a first push-pull cable 506. The first cable 506 is bifurcated to have a branch portion 508. A terminal end of the branch portion 508 extends through an electrically operated clutch device 510 that is affixed to, for example, the throttle body 76. On the other hand, a second push-pull cable 512 is connected to the free end of the control lever 304 that is a part of the throttle valve servomechanism 298. The second cable 512 also extends through the clutch device 510. Normally, the first and second cables 506, 512 are not joined with each other and the throttle valves 84 are disconnected from the remote controller 246. The clutch device 510 is under control of the ECU 90.

The ECU 90 activates the clutch device 510 when the ECU 90 determines that the abnormal condition occurs. The first a second push-pull cables 506, 512 are rigidly coupled with each other under this condition. The control lever 304 of the servomechanism 298 thus moves clockwise in the view of FIG. 21 when the operator operates the control lever 250 of the remote controller 246 to the reverse troll position R. The clockwise movement of the control lever 304 of the servomechanism 298 actuates the throttle valves 84 to the closed position through the linkage rod 292 and the levers 290. Accordingly, the engine speed slows down.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. It should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A propulsion system for a watercraft comprising an internal combustion engine that defines a combustion chamber, a first intake device configured to deliver primary air to the combustion chamber, a first valve configured to regulate an amount of the primary air, a control device configured to set the first valve to a desired position, an operating unit configured to provide the control device with the desired position, a second intake device being configured to deliver secondary air to the combustion chamber, and a second valve configured to control a flow of secondary air to combustion chamber, the control device being configured to determine whether an abnormal condition occurs in setting the first valve to the desired position, the control device being configured to determine whether the amount of the first air is insufficient, the control device being configured to control the second valve to allow the secondary air to move to the combustion chamber when the control device determines that the abnormal condition occurs and the amount of the first air is insufficient.

2. The propulsion system as set forth in claim 1 additionally comprising a valve position sensor configured to sense the actual position of the first valve, the control device being configured to determine whether the abnormal condition occurs based upon an actual position sensed by the valve position sensor and the desired position provided by the operating unit.

3. The propulsion system as set forth in claim 2, wherein the control device is configured to determine that the abnormal condition occurs when a difference between the actual position of the first valve and the desired position is equal to or greater than a preset threshold value.

4. The propulsion system as set forth in claim 2, wherein the control device is configured to determine that the abnormal state occurs when the actual position of the first valve does not follow the desired position provided by the operating unit.

5. The propulsion system as set forth in claim 1 additionally comprising a first valve actuator configured to actuate the first valve toward the desired position, the control device being configured to control the first valve actuator based upon the desired position provided by the operating unit.

6. The propulsion system as set forth in claim 1 additionally comprising a second valve actuator configured to actuate the second valve between a shutting position that does not allow the second air to the combustion chamber and a releasing position that allows the second air to the combustion chamber, the control device being configured to control the second valve actuator.

7. The propulsion system as set forth in claim 1, wherein the control device is configured to control the engine to increase an engine speed when the control device determines that the abnormal state occurs and the amount of the primary air is insufficient.

8. The propulsion system as set forth in claim 1 additionally comprising a firing system configured to fire an air/fuel charge in the combustion chamber, the control device being configured to retard a firing timing of the firing system to decrease the engine speed during an abnormal state of the first valve.

9. A control method for controlling a watercraft propulsion system that has an engine, comprising regulating an amount of air to the engine with a regulating valve, setting the regulating valve to a desired regulating position, providing the desired regulating position to an operating unit, determining whether an abnormal state occurs in setting the regulating valve to the desired regulating position, determining whether the amount of the air is insufficient, and delivering a supplementary amount of air to the engine when the occurrence of the abnormal state is determined and the insufficient condition of the air is determined.

10. The control method as set forth in claim 9 additionally comprising sensing an actual regulating position of the regulating valve, and comparing the actual regulating position with the desired regulating position.

11. The control method as set forth in claim 9 additionally comprising actuating a control valve of an auxiliary air delivery device to deliver the supplementary amount of the air.

12. The control method as set forth in claim 9 additionally comprising determining the amount of the air is insufficient when the regulating valve is placed adjacent to a closed position of an air delivery device more than an open position of the air delivery device.

13. The control method as set forth in claim 9 additionally comprising increasing an engine speed of the engine when the occurrence of the abnormal state is determined and the insufficient condition of the air is determined.

* * * * *

UNITED STATES PATENT AND TRADEMARK OFFICE

CERTIFICATE OF CORRECTION

PATENT NO. : 7,089,910 B2
APPLICATION NO. : 10/619333
DATED : August 15, 2006
INVENTOR(S) : Isao Kanno et al.

It is certified that error appears in the above-identified patent and that said Letters Patent is hereby corrected as shown below:

At column 1, line 66, after "actuator and" insert -- the --.

At column 6, line 18 (approx.), after "schematic" delete ",".

At column 12, line 31, delete "bums" and insert -- burns --, therefor.

At column 22, line 29, delete "S113," and insert -- S13, --, therefor.

At column 24, line 41, delete "S1" and insert -- S10 --, therefor.

Signed and Sealed this

Fourth Day of December, 2007

JON W. DUDAS
*Director of the United States Patent and Trademark Office*